US008303261B1

(12) United States Patent
Hawkins

(10) Patent No.: US 8,303,261 B1
(45) Date of Patent: Nov. 6, 2012

(54) WHEELED, MANUALLY MOVEABLE AIR COMPRESSOR

(76) Inventor: Bobby L. Hawkins, Travelers Rest, SC (US)

( * ) Notice: Subject to any disclaimer, the term of this patent is extended or adjusted under 35 U.S.C. 154(b) by 373 days.

(21) Appl. No.: 12/696,163

(22) Filed: Jan. 29, 2010

Related U.S. Application Data

(60) Provisional application No. 61/148,579, filed on Jan. 30, 2009, provisional application No. 61/151,276, filed on Feb. 10, 2009, provisional application No. 61/218,292, filed on Jun. 18, 2009, provisional application No. 61/231,816, filed on Aug. 6, 2009, provisional application No. 61/242,058, filed on Sep. 14, 2009.

(51) Int. Cl.
*F04B 53/00* (2006.01)
*F04B 17/05* (2006.01)

(52) U.S. Cl. ..... 417/234; 417/364; 137/899.4; 280/6.155

(58) Field of Classification Search ..... 417/234, 417/364; 301/113; 280/6.154, 6.155, 6.156, 280/6.157, 47.24, 47.26, 124.116, 79.11, 280/79.3, 676, 677, 682, 124.11, 124.111, 280/6.15; 137/899, 899.4
See application file for complete search history.

(56) References Cited

U.S. PATENT DOCUMENTS 2,789,756 A * 4/1957 Allen ..... 137/899.4
2,812,041 A * 11/1957 Mugler ..... 188/74
2,812,895 A * 11/1957 Peeps ..... 137/899.4
3,424,440 A * 1/1969 Louis et al. ..... 366/47
RE28,936 E * 8/1976 Talamantez ..... 280/5.2
D243,282 S 2/1977 Burenga
4,077,747 A 3/1978 Burenga
D273,011 S 3/1984 Dudley
D276,997 S * 1/1985 Mikado ..... D13/116
5,480,170 A * 1/1996 Kaiser, II ..... 280/30
D420,773 S * 2/2000 Ertl et al. ..... D32/16
D445,115 S 7/2001 Hutchinson et al.
6,406,270 B1 * 6/2002 Kopel ..... 417/237
6,468,048 B1 10/2002 Burkholder et al.
6,534,958 B1 * 3/2003 Graber et al. ..... 322/11
6,551,066 B2 4/2003 Saylor et al.
6,582,201 B2 6/2003 Lucchi
6,773,237 B2 * 8/2004 Burford et al. ..... 417/234
6,923,475 B1 * 8/2005 Martin et al. ..... 280/789
7,029,240 B2 4/2006 Baron et al.
(Continued)

OTHER PUBLICATIONS

Owner'S Manual, Model TAC-2T, Commercial Dual Tank Compressor, Titan Industries, Revision #030428A, Jul. 2010.

*Primary Examiner* — Devon Kramer
*Assistant Examiner* — Nathan Zollinger
(74) *Attorney, Agent, or Firm* — Dority & Manning, P.A.

(57) ABSTRACT

A wheeled, manually movable, internal combustion engine powered air compressor is mounted in a rigid frame formed of tubular steel elements. A pair of aligned wheels is pivotally mounted independently to each opposite side of the frame. Each pair of aligned wheels is provided with a pivot pin mechanism that enables the rear wheels to be lifted off the ground to facilitate pivoting the unit on the front wheels. Each pair of aligned wheels is selectively detachable from the frame to facilitate shipping. Two gas storage tanks are mounted to the bottom of the frame and disposed side-by-side. The internal combustion engine is mounted toward the front end of the frame. The upper front portion of the frame houses a fuel tank completely within the outline of the frame, and the tank holds more than two gallons of fuel.

18 Claims, 23 Drawing Sheets

U.S. PATENT DOCUMENTS

| | | | | |
|---|---|---|---|---|
| 7,131,824 | B2 | 11/2006 | Baron | |
| D572,659 | S * | 7/2008 | Hawkins | D13/116 |
| D574,020 | S | 7/2008 | Buck et al. | |
| 7,475,888 | B2 * | 1/2009 | Craig et al. | 280/47.18 |
| 7,490,847 | B2 * | 2/2009 | Dahl | 280/638 |
| D597,944 | S * | 8/2009 | Takamura | D13/116 |
| 2008/0240936 | A1 | 10/2008 | Ritterling et al. | |
| 2009/0284022 | A1 * | 11/2009 | Usselman et al. | 290/38 R |

* cited by examiner

WHEELED, MANUALLY MOVEABLE AIR COMPRESSOR

CROSS-REFERENCE TO RELATED APPLICATIONS

This application claims benefit to the following U.S. provisional patent applications: Ser. No. 61/148,579 filed Jan. 30, 2009; Ser. No. 61/151,276 filed Feb. 10, 2009; Ser. No. 61/218,292 filed Jun. 18, 2009; Ser. No. 61/231,816 filed Aug. 6, 2009; and Ser. No. 61/242,058 filed Sep. 14, 2009, the complete disclosures of each of the foregoing applications being hereby incorporated herein by this reference for all purposes.

STATEMENT REGARDING FEDERALLY SPONSORED RESEARCH OR DEVELOPMENT

N/A

BACKGROUND OF THE INVENTION

This application pertains to air compressors that are powered by an internal combustion engine and that have wheels by which they can be moved manually.

Air compressors powered by an internal combustion engine are known, and many examples can be found, including those described in U.S. Pat. Nos. 4,077,747; 6,551,066; 7,029,240 and 7,131,824; the complete disclosures of each of the foregoing patents being hereby incorporated herein by this reference for all purposes.

A typical wheeled air compressor is mounted in a frame. The pressure generating components, i.e., the pump and the internal combustion engine (whether powered by diesel fuel or gasoline) that powers the pump, and the pressurized storage tank, which are the heaviest components, are mounted to the frame. When the storage tank extends the length of the frame as in U.S. Pat. Nos. 6,551,066 and 6,468,048 for example, the storage tank can be located beneath the engine and the pump. Alternatively, as in each of U.S. Pat. Nos. 4,077,747; 6,582,201; 7,029,240 and 7,131,824 for example, one or more storage tank can be located at one end of the frame, and the engine and the pump can be located at the opposite end of the frame. A pair of wheels can be rotatably mounted on an axle that typically will be mounted at one lower end of the rear of the frame with a wheel on each opposite end of the axle that carries the rear end of the frame and up to half the weight of the compressor unit. Opposite the rear end of the frame having the axle and wheels, the front end of the frame typically will have a pair of stationary vertical support feet to carry the other portion of the weight of the compressor unit. As in U.S. Patent Application Publication No. 200810240936, the complete disclosure of this published application being hereby incorporated herein by this reference for all purposes, each one of a pair of storage tanks can be located beside each side of the engine and the pump, and a single wheel rotatable on a single axle carried by the frame can be used to enable the compressor to be moved about as one would move a wheel barrow for example.

A front handle typically will be mounted on the upper portion of the front of the frame opposite the end of the frame where the wheels are mounted. The handle can be stationary or the handle can be pivotally mounted to the frame so that when not in use it can be folded down flush with the front of the frame. The front handle can be used to lift the stationary end of the frame and pull or push the air compressor unit on the two wheels at the rear end of the frame.

OBJECTS AND SUMMARY OF THE INVENTION

It is a principal object of the present invention to provide an improved wheeled, manually movable, internal combustion engine powered air compressor unit that can operate continuously for about five hours on a single tank of fuel.

It is another principal object of the present invention to provide a wheeled, manually movable, internal combustion engine powered air compressor unit capable of being moved off-road to negotiate across relatively rough terrain.

It is a further principal object of the present invention to provide an improved wheeled, manually movable, internal combustion engine powered air compressor unit that quickly and easily can be partially disassembled for ease of shipment and storage and quickly and easily re-assembled once arriving on site for operation.

Additional objects and advantages of the invention will be set forth in part in the description that follows, and in part will be obvious from the description, or may be learned by practice of the invention. The objects and advantages of the invention may be realized and attained by means of the instrumentalities and combinations described below.

To achieve the objects and in accordance with the purpose of the invention, as embodied and broadly described herein, a wheeled, manually movable, internal combustion engine powered (e.g., diesel or gasoline engine powered) air compressor is mounted in a rigid frame formed of tubular steel elements.

A pair of aligned wheels is pivotally mounted to each opposite side of the frame such that the pivot point will be disposed between the front end of the frame and the center of gravity of the overall unit. Each pair of aligned wheels quickly and easily can be disassembled from the frame for ease of shipment and storage and quickly and easily re-assembled to the frame once the unit arrives on site for operation. Locking brakes desirably are provided to restrain at least one set of aligned wheels. Each of the ends of the front legs on the bottom front cross-brace and the rear legs on the bottom rear cross-brace of the air compressor unit's frame desirably carries a support cushion that enables one air compressor unit to be stacked on top of another air compressor unit during shipping and storage.

A retractable twin grip handle desirably is mounted to the upper portion of the rear end of the frame to facilitate pulling the air compressor unit past obstacles that rise above or dip below level terrain. A lifting pivot pin desirably can be provided on each of the left and right wheel supports to facilitate lifting the rearwardly facing wheels in order to negotiate elevated obstacles and to facilitate pivoting the air compressor unit left and right on the frontmost wheels.

A pair of pressurized gas storage tanks, which are two of the heaviest components, desirably are mounted toward the bottom of the frame. The internal combustion engine (diesel or gasoline) and an air compression pump that compresses the air into the gas storage tanks desirably are mounted on a main floor panel that is carried by the frame above the gas storage tanks. The internal combustion engine desirably is mounted toward the front end of the frame above the two pairs of aligned wheels, and the air pump desirably is mounted toward the rear end of the frame. The battery for the engine desirably is carried by the same main floor panel that carries the engine and the pump. The fuel tank desirably is mounted above the engine and has a fill cap on top of the fuel tank. The fill cap desirably has a mechanism to lock the cap to the fuel tank. The upper front portion of the frame houses the fuel tank completely within the outline of the frame, and the upper surface of the fuel tank desirably is disposed beneath the uppermost elements of the frame.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF THE PREFERRED EMBODIMENTS

Reference now will be made in detail to the presently preferred embodiments of the invention, several examples of which being illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of what could be claimed and equivalents thereof. The same numerals are assigned to the same components throughout the drawings and description.

Figure 1:
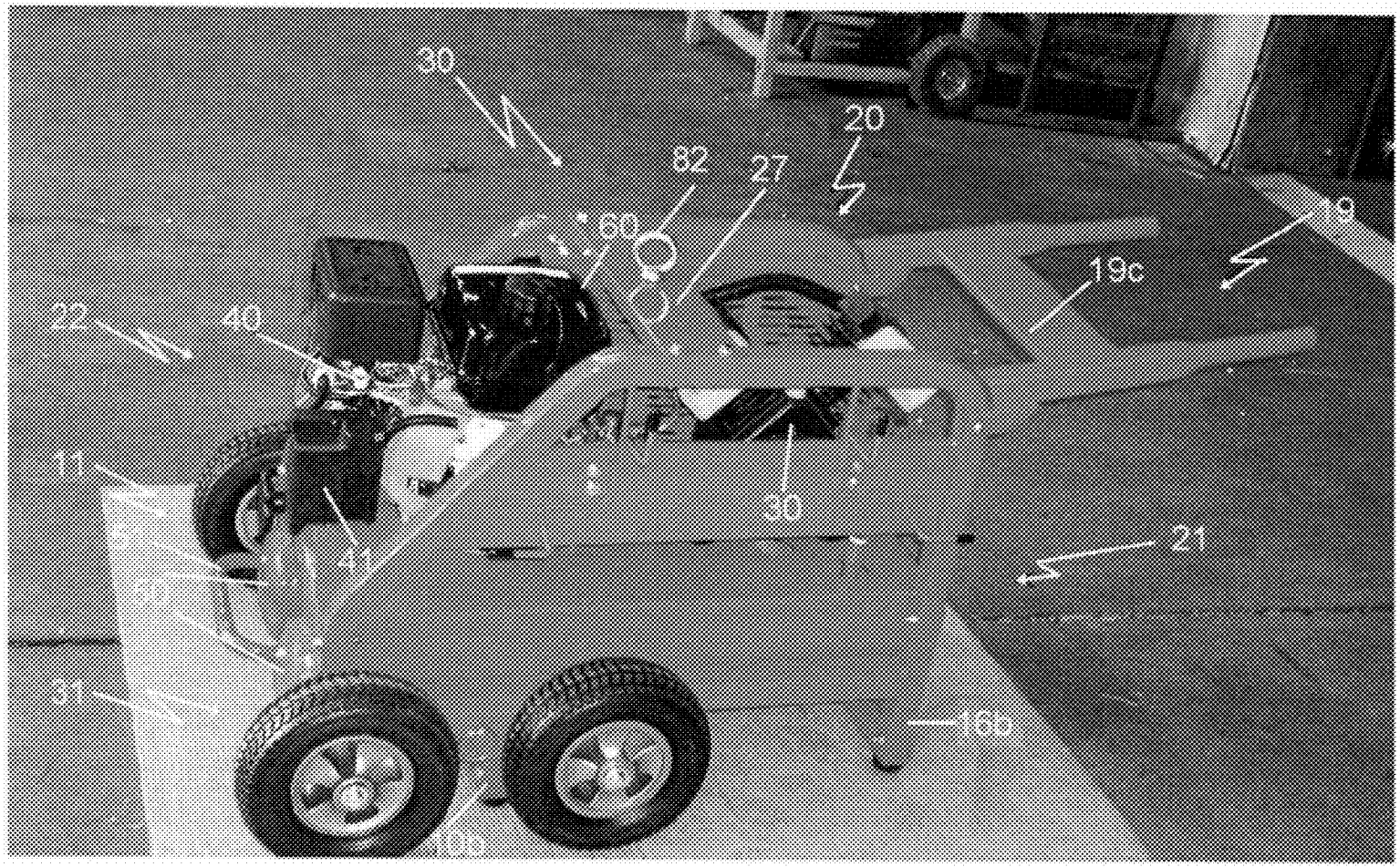
FIG. 1 is an elevated perspective view from the front and left side of a presently preferred embodiment of the wheeled, manually movable, internal combustion engine powered air compressor of the present invention.

One of the presently preferred embodiments of the wheeled, manually movable, internal combustion engine powered air compressor unit is shown in FIG. 1 and is represented generally by the numeral 15. The wheeled, manually movable, internal combustion engine powered air compressor unit 15 desirably can include a rigid frame generally designated by the numeral 20, an air compression pump 30, an internal combustion engine 40 that powers the pump 30, a fuel tank 60 for the engine 40, an air filter 41 for the engine 40, an exhaust muffler 42 for the engine 40, a pair of gas storage tanks 50 to hold the compressed air connected by a hollow conduit 51, and a pair of dual wheel assemblies 11, 31. The engine 40 desirably is provided by a six horsepower gasoline fueled internal combustion engine. The pump 30 desirably can generate 12 cubic feet of air per minute at a pressure of 100 pounds per square inch. The outlet of the pump 30 is connected to the gas storage tanks 50 in conventional fashion and provides compressed air to fill the gas storage tanks 50 from which pressurized air can be regulated for release in conventional fashion.

The frame 20 is desirably formed of 16 gauge tubular steel elements. In the views shown in FIGS. 2-11, some of the components of the wheeled, manually movable, internal combustion engine powered air compressor unit 15 are shown pulled away from the frame 20 or omitted altogether. As shown in FIG. 1, the frame 20 desirably is divided into a rear end 21 and a front end 22 disposed opposite in an axial direction to the rear end 21. The frame's longest dimension is the frame's length, and the frame's length elongates in the frame's longitudinal (or axial) direction between the rear end 21 and the front end 22. When the air compressor unit 15 is resting on the ground on the frame's rear legs 16 and on the wheels of the compressor unit 15, the frame's height is the frame's measurement in the vertical direction above the ground. The remaining rectilinear measurement of the frame is the frame's width, which is measured orthogonally and transversely with respect to the frame's length and height. Thus, the frame further defines a first side and a second side spaced apart in the transverse direction from the first side.

Figure 6:
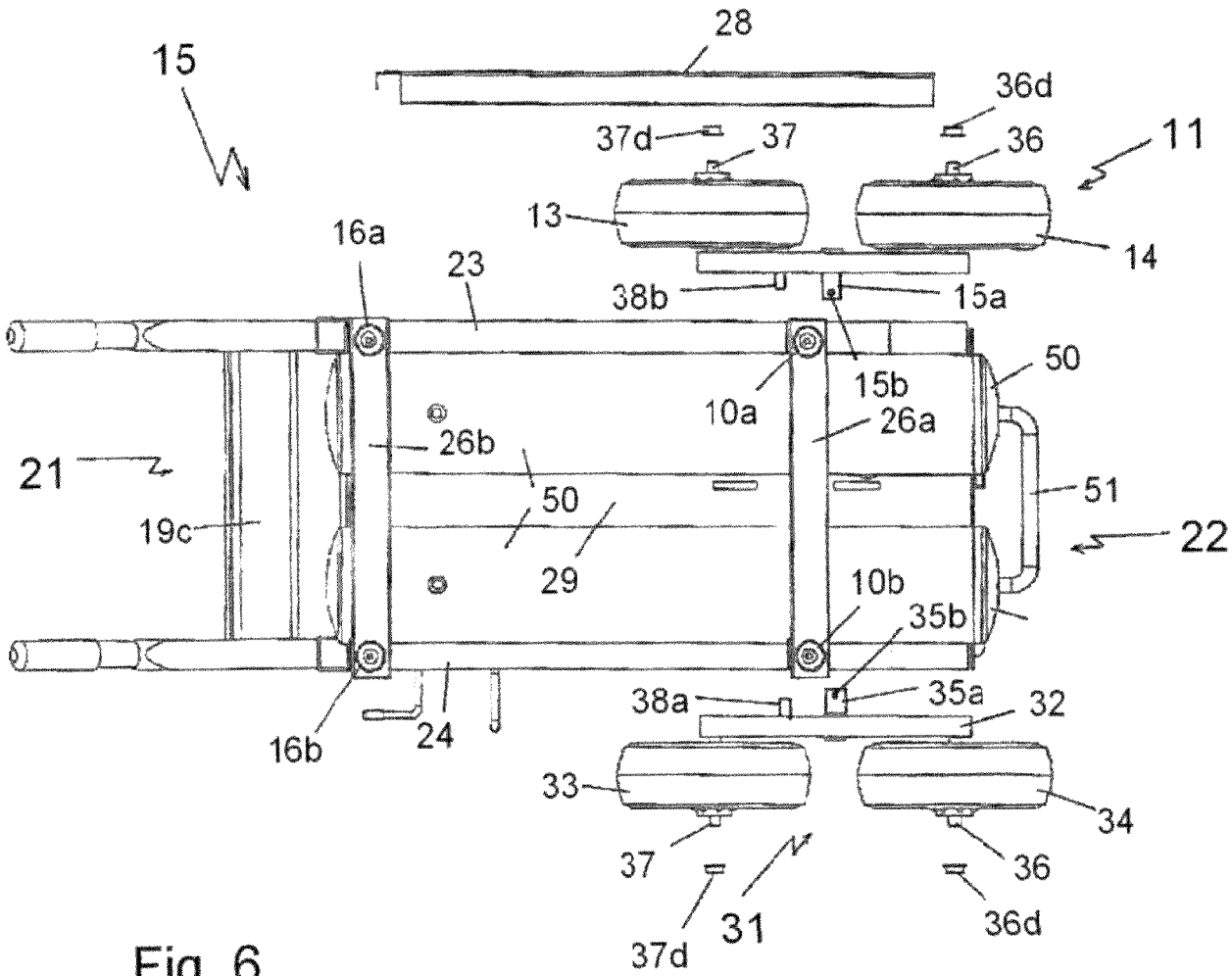
FIG. 6 is a plan view from beneath a partially assembled, preferred embodiment of the wheeled, manually movable, internal combustion engine powered air compressor of the present invention.
Figure 7:
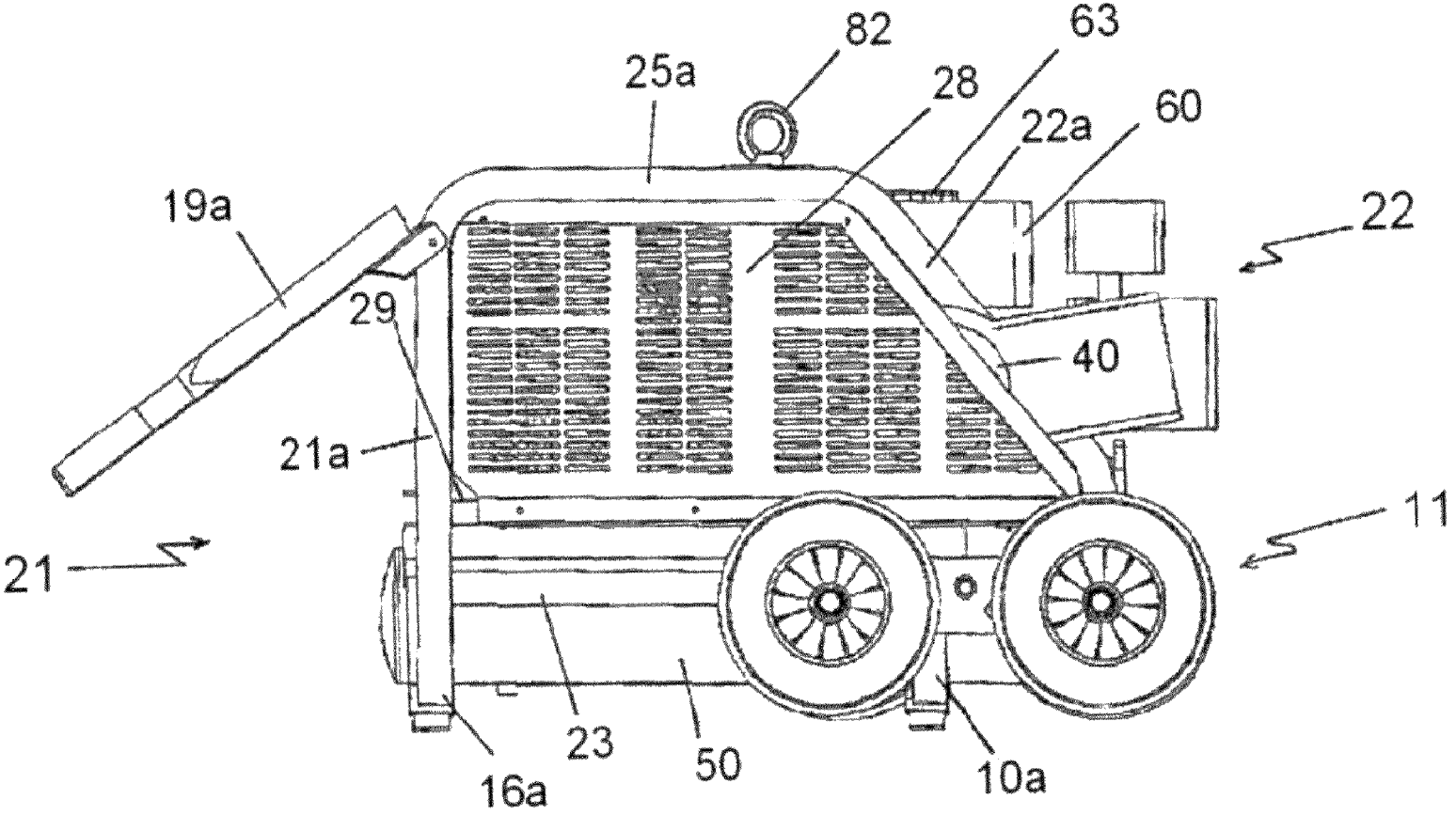
FIG. 7 is a plan view from the right side of an embodiment of the wheeled, manually movable, internal combustion engine powered air compressor of the present invention.

As shown in FIGS. 6 and 7, the lower portion of the right side of the frame desirably includes a right bottom rail 23 connected to a right rear leg 16*a* and a right front leg 10*a*. As shown in FIG. 7, the frame desirably can include a right rear upright member 21*a* having one end connected to or unitary with the right rear leg 16*a* and an upper end connected to or unitary with a rear end of a right top rail 25*a*. The front end of the right top rail 25*a* desirably can be connected to or unitary with the upper end of a right front member 22*a*, and the lower end of the right front member 22*a* desirably can be connected to or unitary with the front end of the right bottom rail 23.

Figure 2:
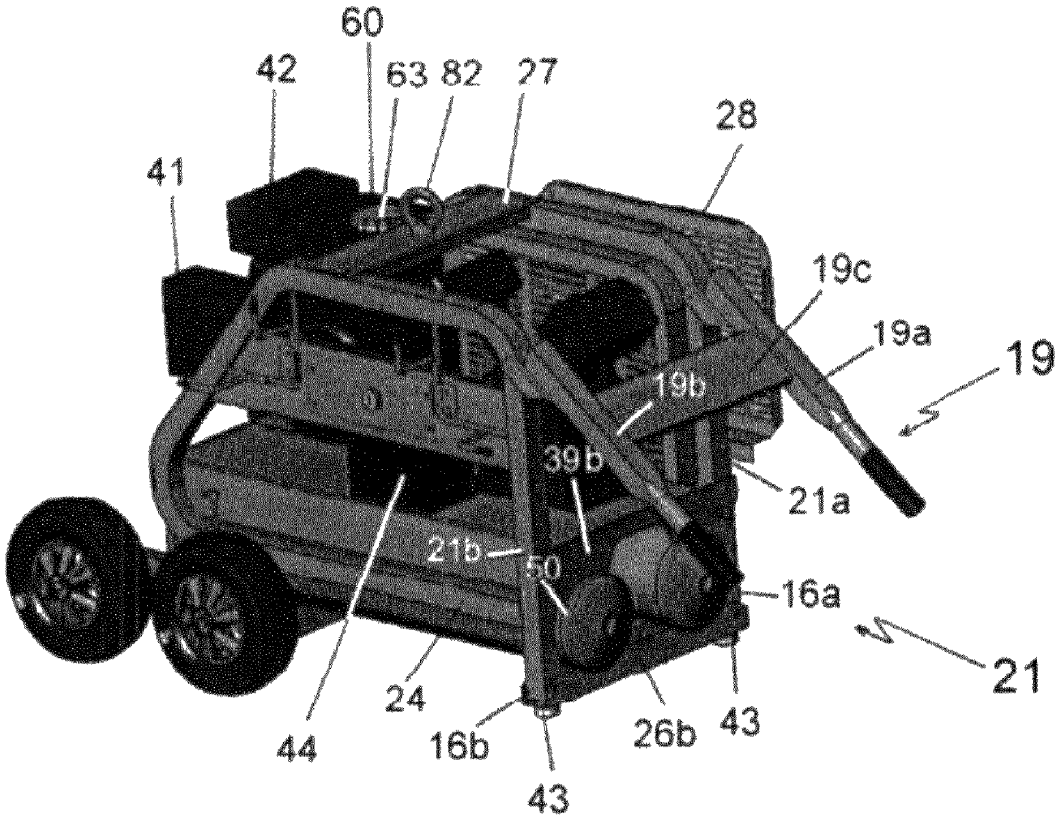
FIG. 2 is an elevated perspective view of the rear and left side of a partially assembled, preferred embodiment of the wheeled, manually movable, internal combustion engine powered air compressor of the present invention.
Figure 8:
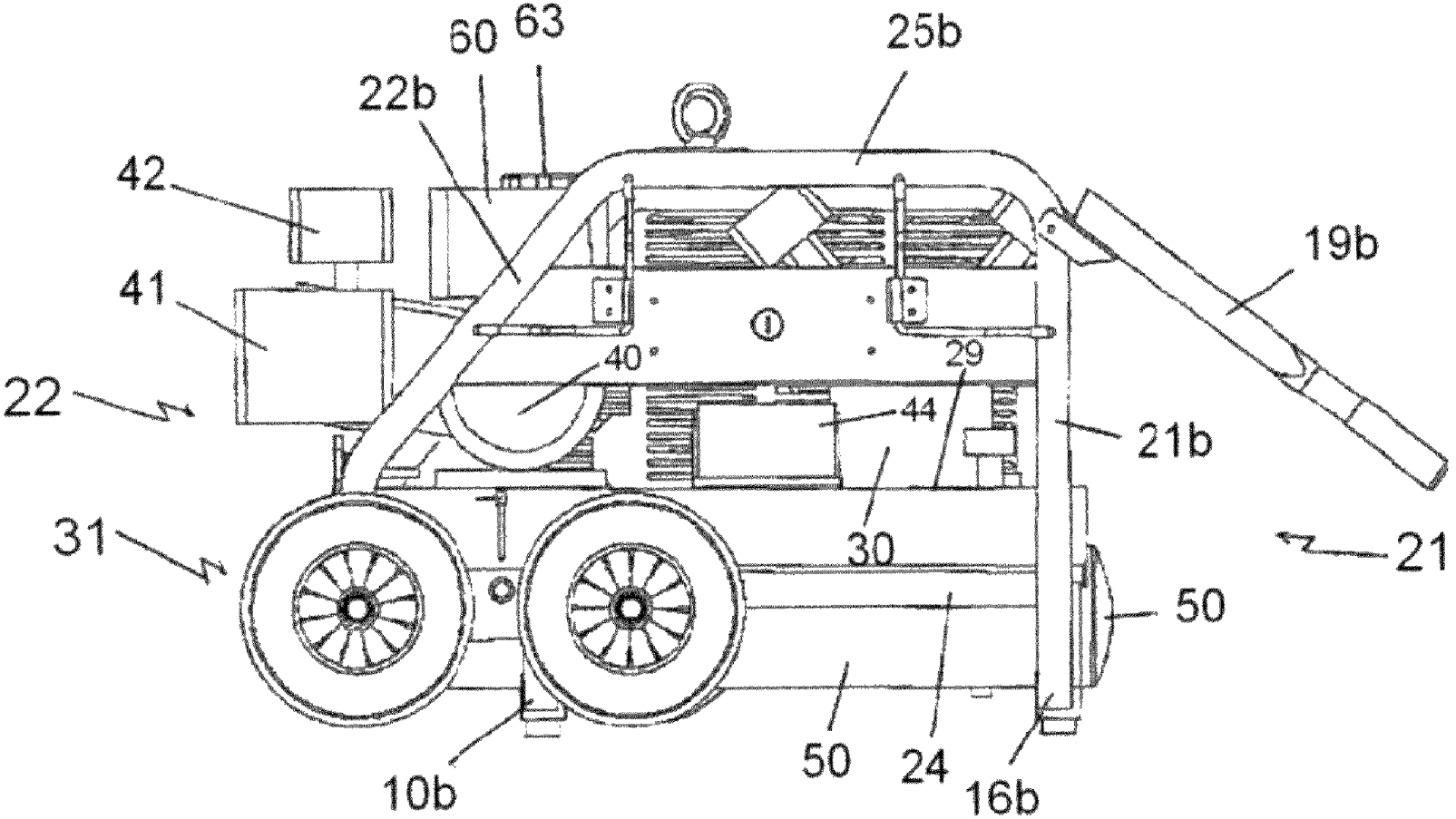
FIG. 8 is a plan view from the left side of an embodiment of the wheeled, manually movable, internal combustion engine powered air compressor of the present invention.

As shown in FIGS. 2, 6 and 8, the lower portion of the left side of the frame desirably can include a left bottom rail 24. As shown in FIGS. 6 and 8, the left bottom rail 24 desirably is connected to a left rear leg 16*b* and a left front leg 10*b*. As shown in FIG. 8, the frame desirably can include a left rear upright member 21*b* having a lower end connected to or unitary with a left rear leg 16*b* and an upper end connected to or unitary with the rear end of a left top rail 25*b*. The front end of the left top rail 25*b* desirably can be connected to or unitary with the upper end of a left front member 22*b*, and the lower end of the left front member 22*b* desirably can be connected to or unitary with the front end of the left bottom rail 24. In a presently preferred embodiment, the length of the unit 15 measured between the front edge of the left front member 22*b* and the rear edge of the left rear member 21*b* is about thirty-one and three quarters inches.

Figure 5:
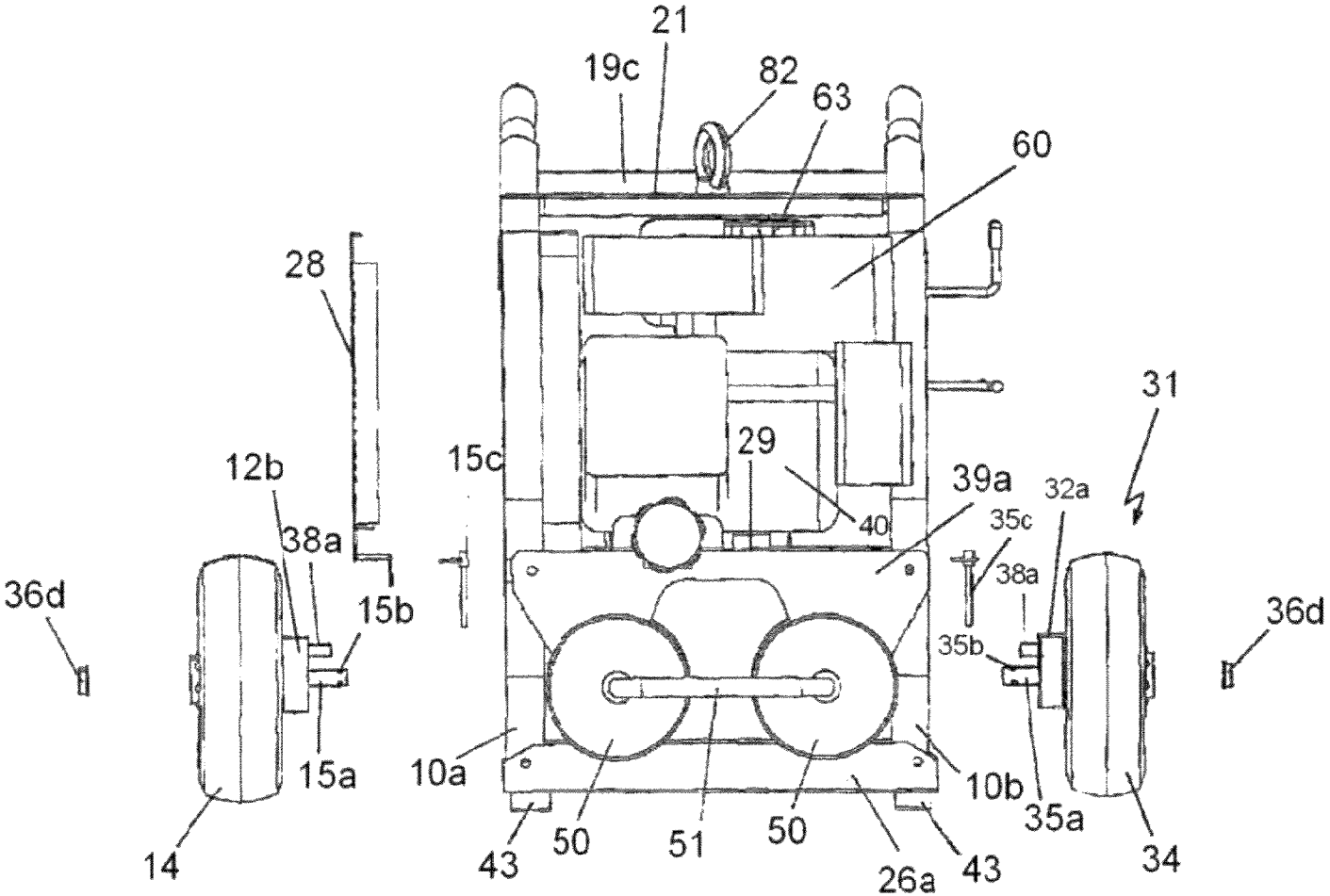
FIG. 5 is a plan view of the front of a partially assembled, preferred embodiment of the wheeled, manually movable, internal combustion engine powered air compressor of the present invention.

As shown in FIG. 5 for example, a fuel tank 60 for the engine 40 desirably is mounted to the upper portion of the rear end 21 of the frame 20 above where the engine 40 rests atop the main floor panel 29. As shown in FIG. 7 for example, a fill cap 63 desirably has a mechanism to lock the cap 63 to the fuel tank 60. The fill cap 63 desirably is disposed flush with the uppermost elements of the frame 20, and thus the upper front portion 22 of the frame 20 houses the fuel tank 60 completely within the outline of the frame 20. The fuel tank 60 desirably has enough capacity to run the engine 40 for up to about five hours, a normal work session, and holds more than two gallons of fuel and desirably holds 2.3 gallons of gasoline fuel.

As shown in FIG. 2 for example, a retractable, rear handle 19 is pivotally mounted to be extendable from the upper portion of the rear end 21 of the frame 20. The rear handle 19 can include at least one cross brace 19*c* connecting a right grip handle 19*a* that extends parallel to and spaced apart from a left grip handle 19*b*. As shown in FIGS. 7 and 8 for example, one end of the right grip handle 19*a* is pivotally mounted to the upper end of the right rear upright member 21*a* of the frame, and one end of the left grip handle 19*b* is pivotally mounted to the upper end of the left rear upright member 21*b* of the frame. As shown in FIG. 2, the rear handle 19 can be retracted selectively by the user from its fully horizontally extended orientation (shown in FIG. 1) to a position (not shown in FIG. 2) whereby the rear handle 19 lies flush with the rear end 21 of the frame 20, and the right grip handle 19*a* rests against the right rear upright member 21*a* and the left grip handle 19*b* rests against the left rear upright member 21*b*. The ability of the handle 19 to assume the fully retracted position against the rear end 21 of the frame 20 facilitates storage of an individual compressor unit 15 and shipment of multiple compressor units 15 together.

As shown in FIG. 5 for example, each front leg 10*a*, 10*b* desirably is provided with a support cushion 43 fixed at the free end of each front leg 10*a*, 10*b*. As shown in FIG. 2 for example, each rear leg 16*a*, 16*b* desirably is provided with a support cushion 43 fixed at the free end of each rear leg 16*a*, 16*b*. During shipping of multiple air compressor units 15, it is desirable to be able to rest one air compressor unit 15 on top of another air compressor unit 15 without fear that the air compressor unit 15 underneath will become damaged by the air compressor unit 15 stacked above. Moreover, it is desirable that such stacking can be effected without fear that the air compressor unit 15 stacked above will slide with respect to the air compressor unit 15 stacked below. Accordingly, each support cushion 43 desirably is formed of resilient, high friction material to rest against the upper frame of an air compressor unit 15 stacked underneath.

Figure 4:
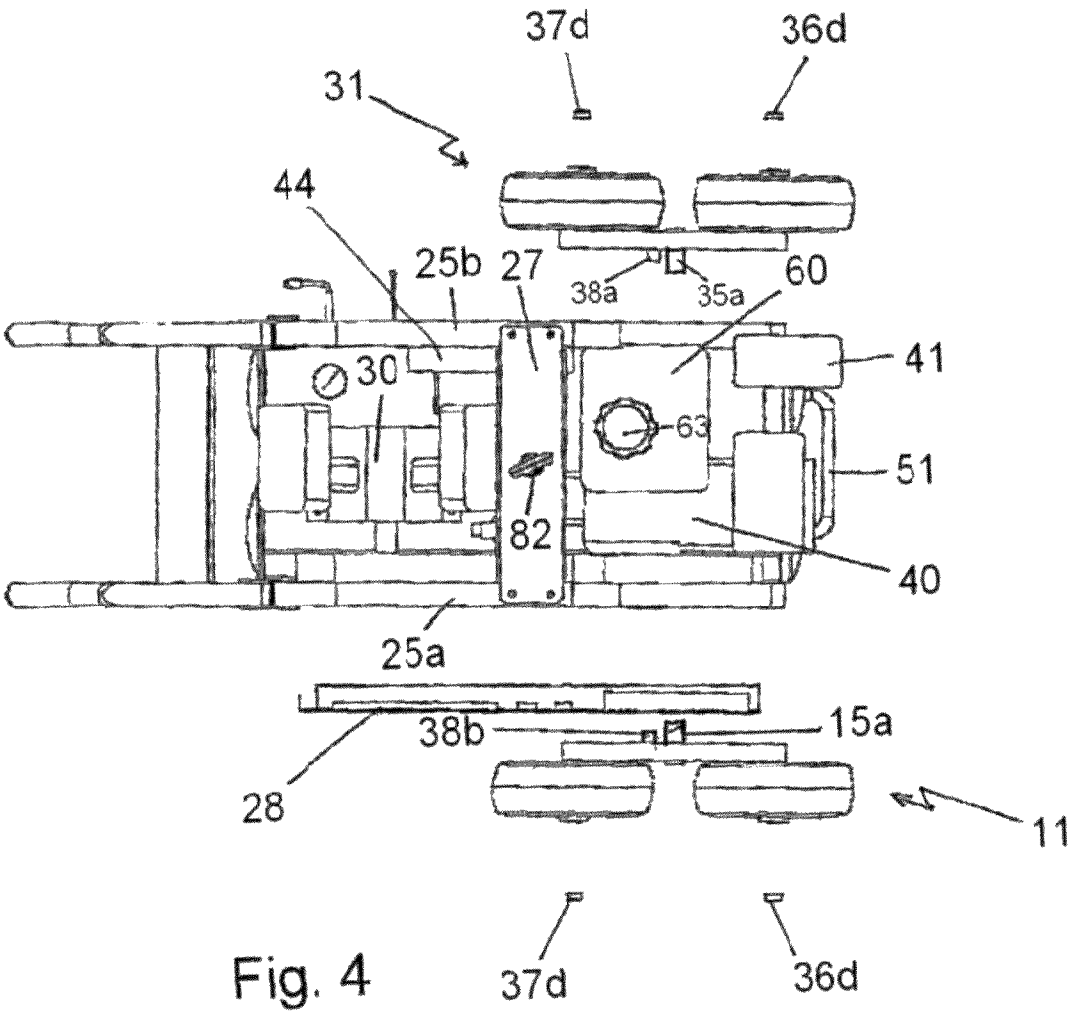
FIG. 4 is a plan view from above a partially assembled, preferred embodiment of the wheeled, manually movable, internal combustion engine powered air compressor of the present invention.

As shown in the top plan view of FIG. 4, the frame desirably can include a top cross brace 27 having its opposite ends connected to one of the right top rail 25*a* and the left top rail 25*b*. Though not shown in FIG. 2, an opening desirably is provided vertically through the top cross brace 27, and a threaded nut desirably is welded to the underside of the top cross brace 27 so that the threaded opening in the nut is concentrically aligned with the opening through the top cross brace 27. The threaded opening in the nut desirably is configured for selectively detachably receiving a threaded end of a bolt portion of a lifting eye fixture 82. The lifting eye fixture 82 facilitates lifting the air compressor unit 15 with a crane. The lifting eye fixture 82 is configured to be selectively detachable by being unscrewed from the threaded opening formed in nut welded beneath the top cross brace 27. Detaching the lifting eye fixture 82 facilitates the stacking of one air compressor unit 15 on top of another air compressor unit 15, prior to shipping.

Figure 16:
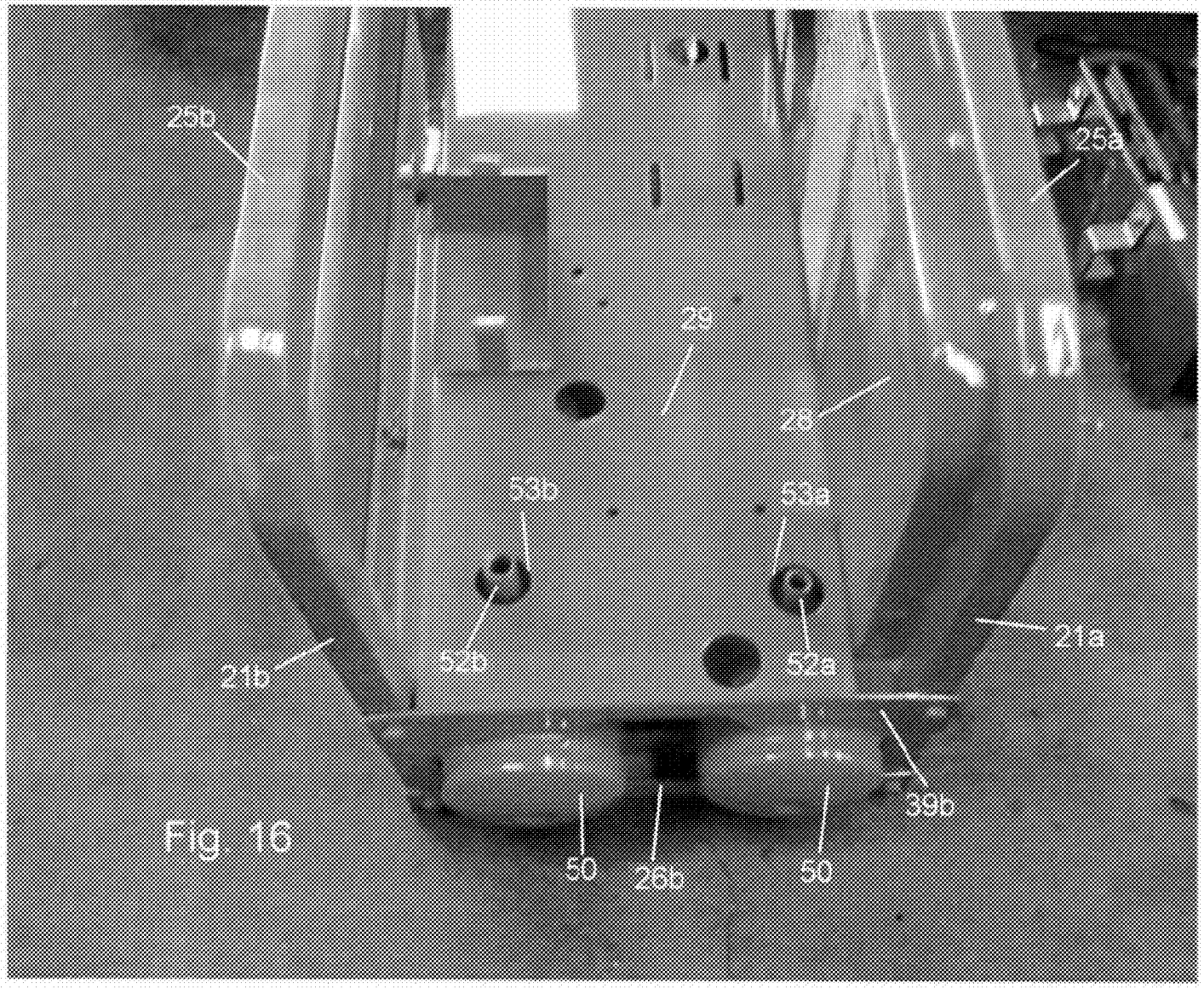
FIG. 16 is an elevated perspective view from the rear end of components of a partially assembled embodiment of the wheeled, manually movable, internal combustion engine powered air compressor unit of the present invention.

As shown in the perspective view of FIG. 16, the frame desirably includes a main floor panel 29. As shown in the perspective view of FIG. 3, the main floor panel 29 carries the internal combustion engine 40, the engine's air filter 41 and the pump 30. As shown in FIG. 8, the main floor panel 29 also carries the battery 44 for the internal combustion engine 40. As shown in the perspective view of FIG. 1, the internal combustion engine 40 and the fuel tank 60 desirably are mounted toward the front end 22 of the frame 20 and above the two wheel assemblies 11, 31, and the pump 30 of the air compressor unit 15 desirably is mounted toward the rear end 21 of the frame 20 between the wheel assemblies 11, 31 and the rear legs 16. As shown in FIG. 7 for example, a screen panel 28 desirably covers the right side of the air compressor unit 15, and the bottom edge of the screen panel 28 desirably connects to the main floor panel 29.

As shown in the perspective view of FIG. 16, the storage tanks 50 for the compressed gas are disposed beneath the main floor panel 29. An inlet conduit 52*a* has one end connected to one of the gas storage tanks 50 and one end projecting through a hole 53*a* in the main floor panel 29. Though not shown in FIG. 16, the inlet conduit 52*a* desirably is configured to be connected to a gas regulator fixture from which compressed gas leaving the compressor pump 30 can be supplied into the gas storage tanks 50. An outlet conduit 52*b* has one end connected to one of the gas storage tanks 50 and one end projecting through a hole 53*b* in the main floor panel 29. Though not shown in FIG. 16, the outlet conduit 52*b* desirably is configured to be connected to a gas regulator fixture from which compressed gas from the storage tanks 50 can be connected to an appliance that is powered by the compressed gas.

Figure 10:
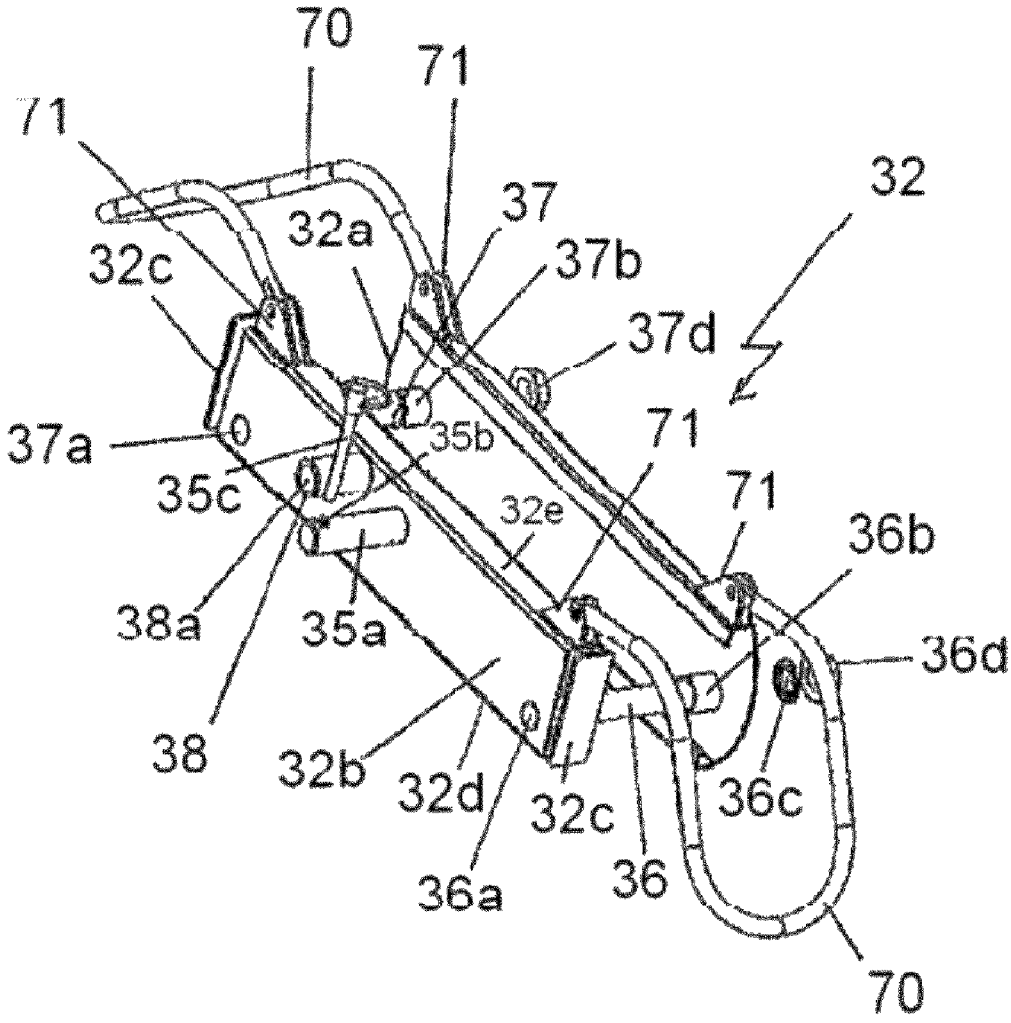
FIG. 10 is an elevated perspective view of an assemblage of components of an embodiment of a wheel assembly of a presently preferred embodiment of the wheeled, manually movable, internal combustion engine powered air compressor of the present invention.
Figure 19A:
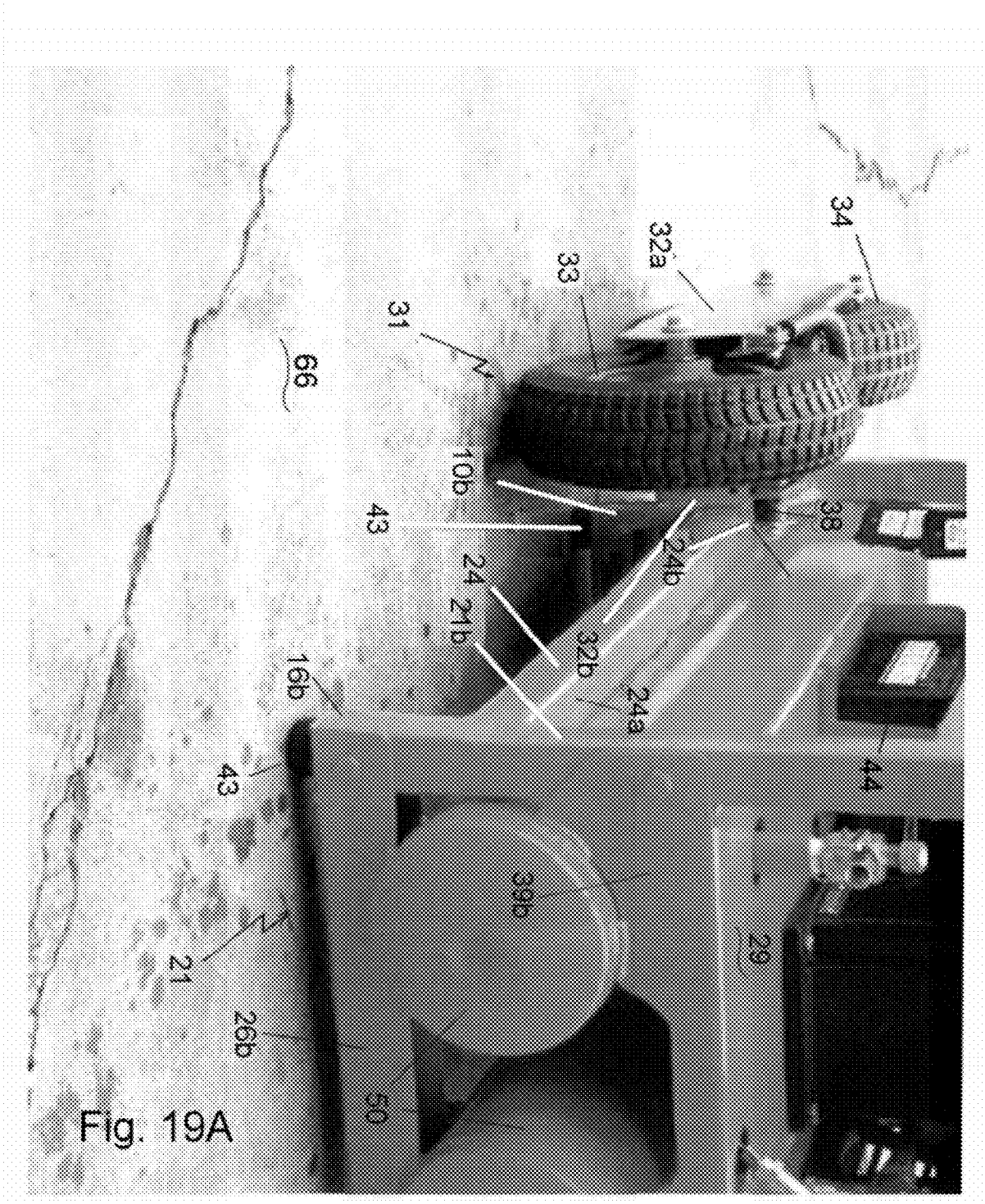
FIG. 19A is an elevated perspective view of assembled components of a presently preferred embodiment of a wheeled, manually movable, internal combustion engine powered air compressor unit of the present invention.

As shown in the front plan view of FIG. 5, a front collar 39*a* desirably is configured to conform to the outer shape of each of the two gas storage tanks 50 and is connected to the frame so as to hold the front ends of the storage tanks 50 securely against the front bottom cross-brace 26*a*. As shown in the bottom plan view of FIG. 6, the frame also desirably can include a rear bottom cross-brace 26*b* having one end connected to the right rear leg 16*a* and an opposite end connected to the left rear leg 16*b*. As shown in the perspective views of FIGS. 2, 16 and 19A for example, a rear collar 39*b* desirably is configured to conform to the outer shape of each of the two gas storage tanks 50 and is connected to the frame so as to hold the rear ends of the storage tanks 50 securely against the rear bottom cross-brace 26*b*. The right wheel assembly 11 and the left wheel assembly 31 are mirror images of each other, and thus for the sake of brevity, most of the detailed description will be directed to the left wheel assembly 31. FIG. 10 illustrates an elevated perspective view of a left wheel support 32 before the wheels are attached and before the left wheel support 32 is pivotally attached to the lower left rail 24 of the frame 20. As shown in FIG. 10 for example, a left wheel support 32 desirably includes an outer left wheel support 32*a* and an inner left wheel support 32*b*. The inner left wheel support 32*b* desirably can be formed by a length of rectangular cross-section extrusion of 18 gauge cold rolled, tubular steel having about a 60,000 psi rating. As shown in FIG. 10, each opposite end of the inner left wheel support 32*b* desirably can be sealed by an end cap 32*c* that is press fit onto the open end of the tubular extrusion that desirably forms the inner left wheel support 32*b*, and the end cap 32*c* desirably is formed of plastic or rubber. As shown in FIG. 10 for example, in a presently preferred embodiment, the inner left wheel support 32*b* has a height of about three inches measured between the lower edge 32*d* and the upper edge 32*e*, a length of about thirteen and three-quarters inches measured between the opposite ends, and a thickness or depth of about one inch measured orthogonally with respect to each of the height and length.

As shown in FIG. 10 for example, one end 36*a* of a front wheel axle 36 can be permanently attached (as by welding for example) to the inner left wheel support 32*b*, and one end 37*a* of a rear wheel axle 37 can be permanently attached (as by welding for example) to the inner left wheel support 32*b*. In a presently preferred embodiment, each wheel axle 36, 37 desirably is made of steel and has a diameter of about five-eighths of an inch, and the central axis of rotation of each wheel axle 36, 37 desirably is disposed about five-eighths of an inch above the lower edge 32*d* of the inner left wheel support 32*b* and the central axes of the two wheel axles 36, 37 desirably are spaced about twelve and three-eighths inches apart and centered with respect to the ends of the inner left wheel support 32*b*.

Figure 9:
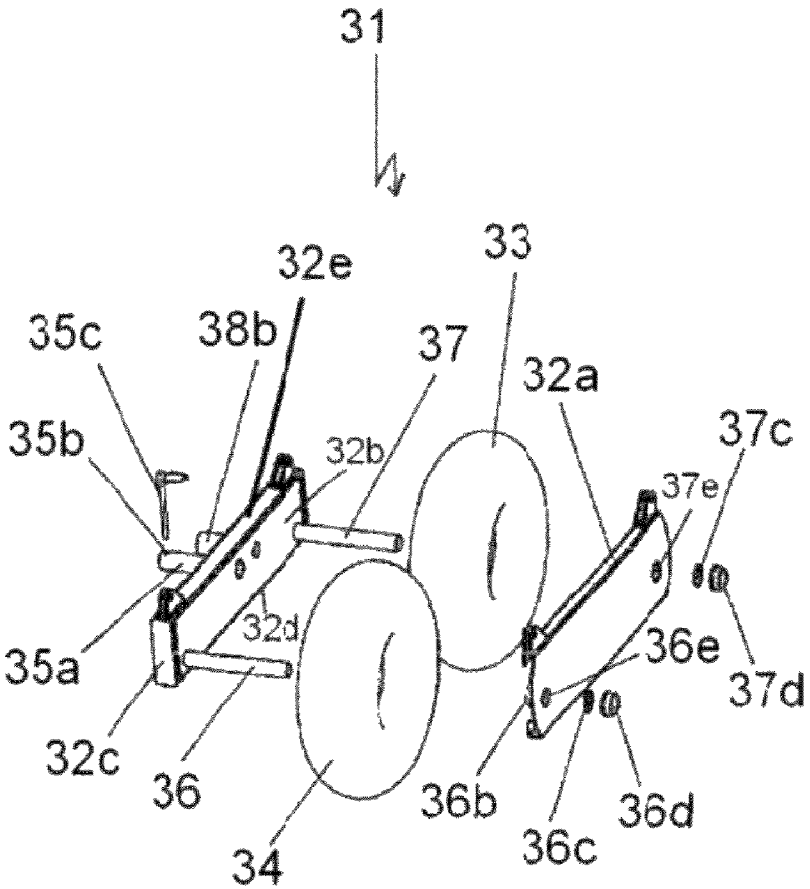
FIG. 9 is an elevated perspective view of an assemblage of components of an embodiment of a wheel assembly of a presently preferred embodiment of the wheeled, manually movable, internal combustion engine powered air compressor of the present invention.

FIG. 9 illustrates disassembled components of a left wheel assembly 31 before the wheels 33, 34 are attached and before the inner left wheel support 32*b* is pivotally attached to the lower left rail 24 of the frame 20. As shown in the perspective view of FIG. 9 for example, components of a left wheel assembly 31 can include two left wheels 33, 34 rotatably mounted to the inner left wheel support 32*b*. In a presently preferred embodiment, each wheel 33, 34 is formed of solid rubber and has a diameter of about ten inches and a tread that is about three and three-eighths of an inch wide. As shown in FIG. 9 for example, the two left wheels include a front left wheel 34 that is rotatably disposed on the front wheel axle 36 and a rear left wheel 33 that is rotatably disposed on the rear wheel axle 37. The front left wheel 34 and the rear left wheel 33 desirably are aligned with each other such that the axis of rotation of each wheel 33, 34 is spaced apart from and parallel to the axis of rotation of the other wheel 33, 34 in the left wheel assembly 31.

As shown in FIGS. 9 and 10 for example, a left wheel assembly axle (aka left wheel assembly journal) 35*a* can be mounted permanently (as by welding for example) to the inner left wheel support 32*b*. In a presently preferred embodiment, the left wheel assembly axle 35*a* has a diameter of about three-quarters of an inch and the central axis of rotation of the left wheel assembly axle 35*a* is disposed about two inches above the lower edge 32*d* of the inner left wheel support 32*b*. In a presently preferred embodiment, the central axis of rotation of the left wheel assembly axle 35*a* is disposed equidistantly from each of the opposed ends of the inner left wheel support 32*b*. In a presently preferred embodiment, the central axis of rotation of the left wheel assembly axle 35*a* is disposed equidistantly from each of the axes of rotation of the front and rear axles 36, 37, which desirably are spaced apart at their central axes by about a foot. In a presently preferred embodiment, the central axes of rotation of the left wheel assembly axle 35*a* and the two wheel axles 36, 37 form an isosceles triangle in the plane of the inner left wheel support 32*b* as well as in any normal plane passing through all three axes.

Figure 11:
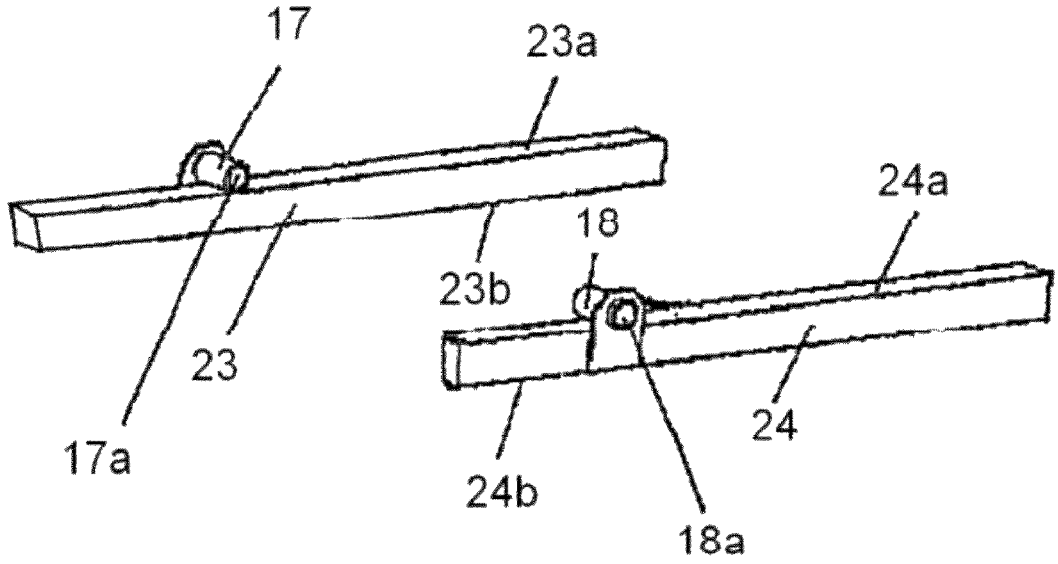
FIG. 11 is an elevated perspective view of the left and right lower rails of a presently preferred embodiment of the wheeled, manually movable, internal combustion engine powered air compressor of the present invention.
Figure 12:
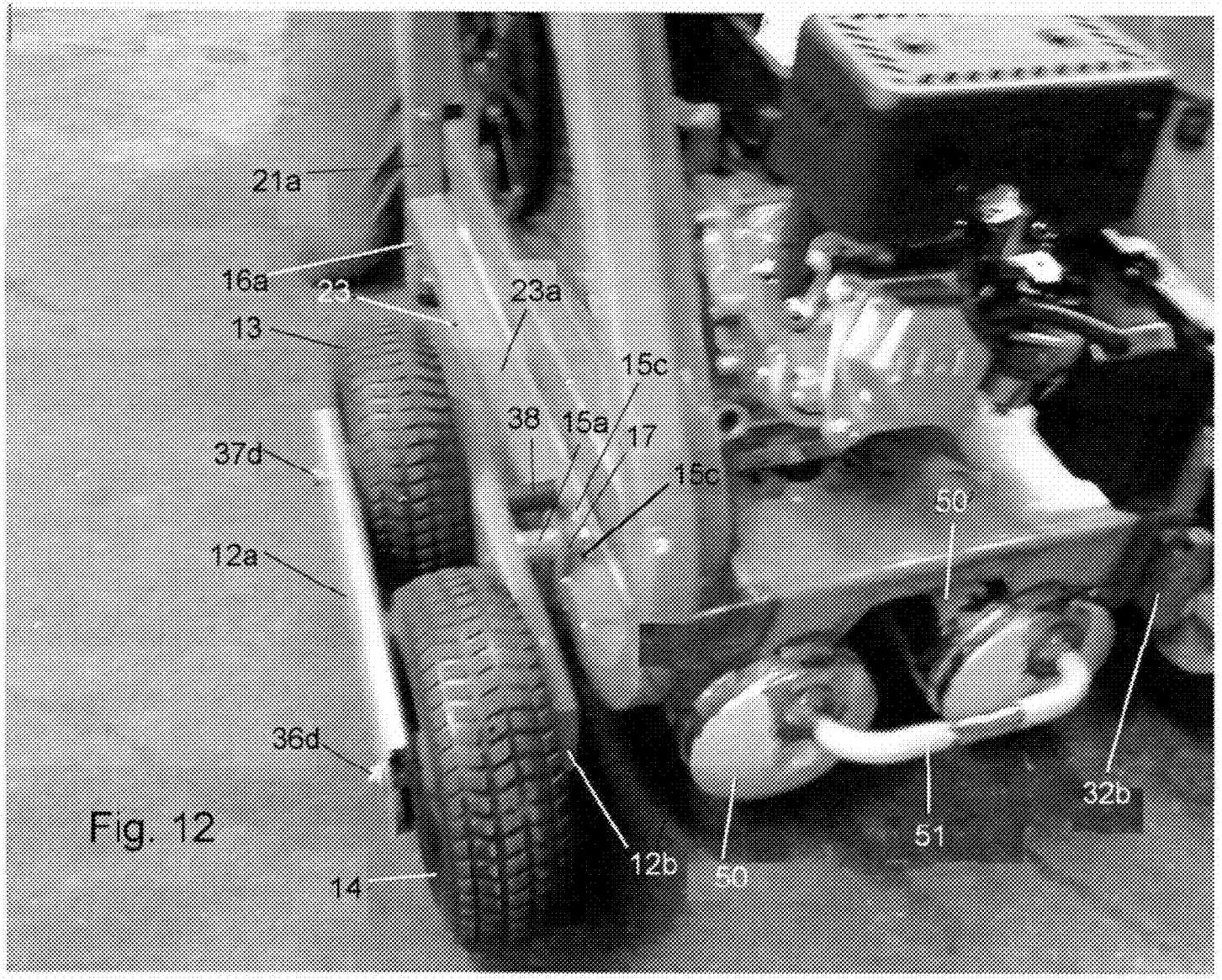
FIG. 12 is an elevated perspective view of the front right side of a presently preferred embodiment of the wheeled, manually movable, internal combustion engine powered air compressor of the present invention.
Figure 12A:
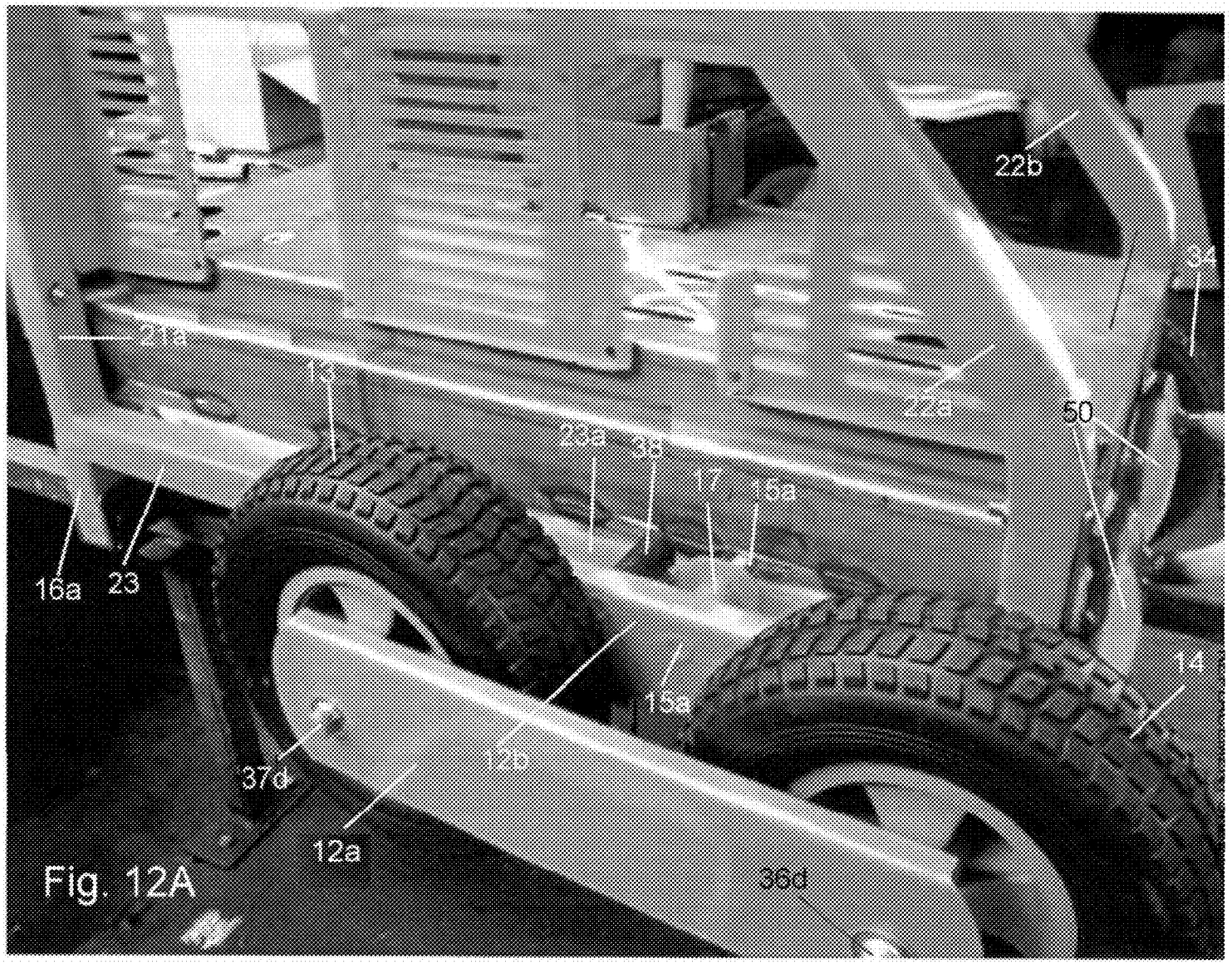
FIG. 12A is an elevated perspective view of the front right side of a partially assembled portion of a presently preferred embodiment of the wheeled, manually movable, internal combustion engine powered air compressor of the present invention.
Figure 12B:
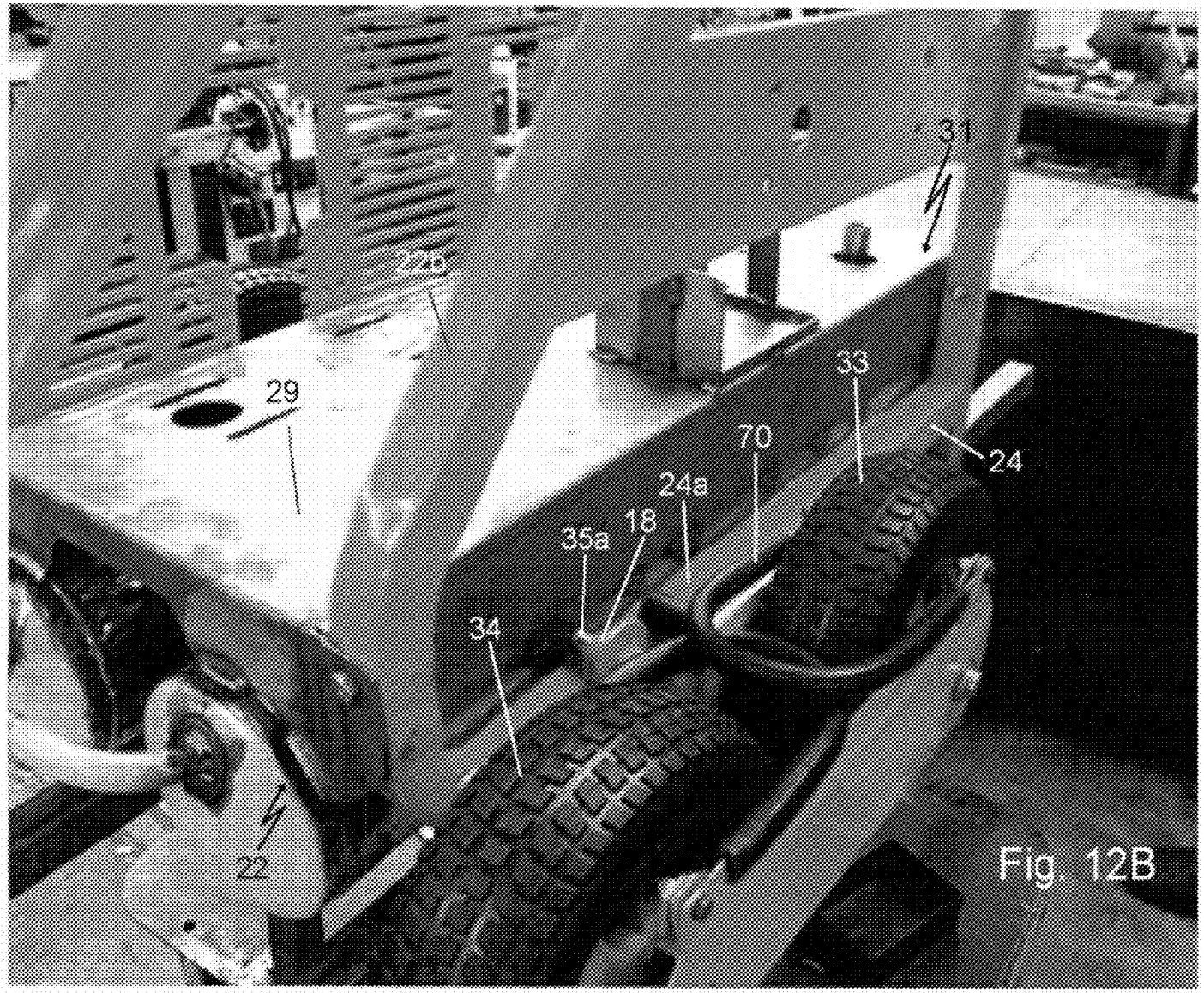
FIG. 12B is an elevated perspective view of the front left side of a partially assembled portion of a presently preferred embodiment of the wheeled, manually movable, internal combustion engine powered air compressor of the present invention.
Figure 13:
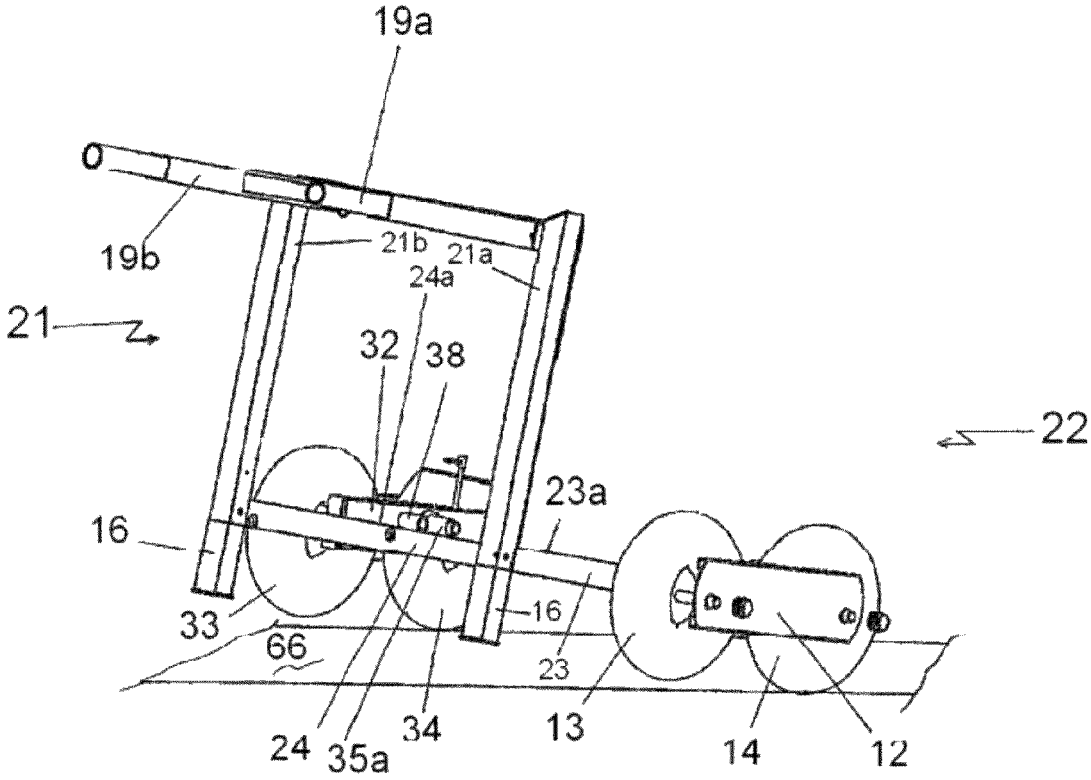
FIG. 13 is an elevated perspective view from the front right side of components of a partially assembled embodiment of the wheeled, manually movable, internal combustion engine powered air compressor unit of the present invention.

As shown in FIG. 11 for example, a left wheel bearing 18 is formed by a hollow cylindrical section of a stainless steel tube that is rigidly and permanently mounted (as by welding for example) to the upper surface 24*a* of the left bottom rail 24 at the lower portion of the left side of the frame 20. The left wheel bearing 18 defines a cylindrically shaped opening 18*a* that is configured to rotatably receive therein the left wheel assembly axle 35*a* of the left wheel support 32. In this way, as shown in FIG. 12B for example, the left wheel assembly 31 desirably is pivotally mounted to the lower left side of the frame 20 toward the front end 22 of the frame so that the left wheel assembly 31 is constrained to pivot in a manner that maintains the two left wheels in the same plane during the pivoting movement.

Figure 17:
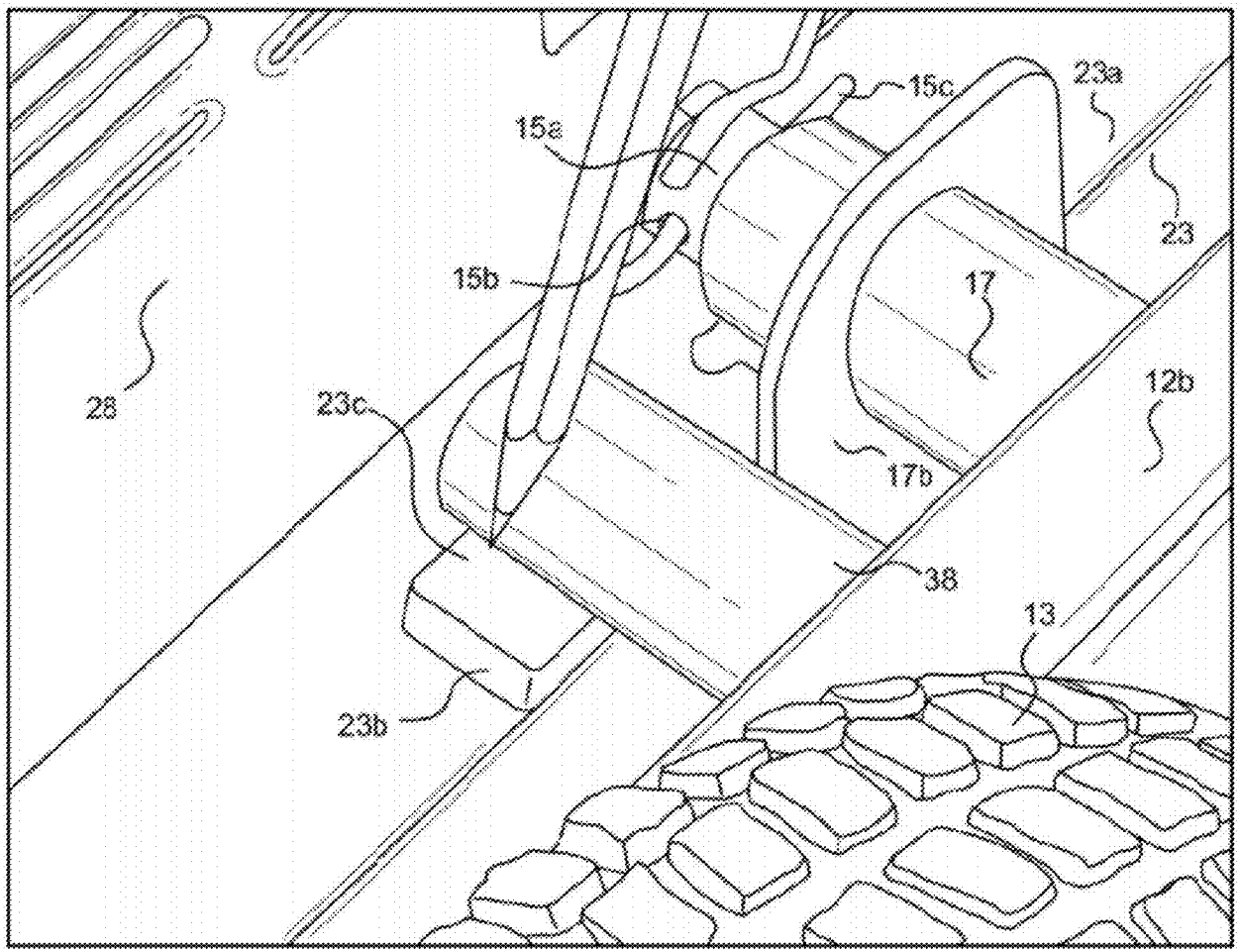
FIG. 17 is an elevated perspective view of assembled components of a presently preferred embodiment of a wheeled, manually movable, internal combustion engine powered air compressor unit of the present invention.

As similarly shown in FIGS. 11, 12, 12A, 17 and 18, a right wheel bearing 17 is formed by a hollow cylindrical section of a stainless steel tube that is rigidly and permanently mounted (as by welding for example) to the upper surface 23*a* of the right bottom rail 23 at the lower portion of the right side of the frame 20. As shown in FIG. 11, the right wheel bearing 17 defines a cylindrically shaped opening 17*a* that is configured to rotatably receive therein the right wheel assembly axle (aka right wheel assembly journal) 15*a* of the inner right wheel support 12*b*. In this way, the right wheel assembly 11 desirably is pivotally mounted to the lower right side of the frame 20 toward the front end 22 of the frame so that the right wheel assembly 11 is constrained to pivot in a manner that maintains the two right wheels in the same plane during the pivoting movement. As shown in FIG. 17, a flange 17*b* supports the right wheel bearing 17 and is connected to the right bottom rail 23 in order to lend support to maintain the position of the right wheel bearing 17 relative to the upper surface 23*a* of the right bottom rail 23. A similar flange is provided to support the left wheel bearing 18 and is connected to the left bottom rail 24.

As shown in the front plan view of FIG. 5 and the bottom plan view of FIG. 6, the frame desirably can include a front bottom cross-brace 26*a* having one end connected to the right front leg 10*a* and an opposite end connected to the left front leg 10*b*. As shown in the bottom plan view of FIG. 6, the front bottom cross-brace 26*a* extends across the width of the frame and desirably is disposed just rearwardly of where the left wheel assembly axle 35*a* extends transversely into the left bearing sleeve 18 carried by the left bottom rail 24 and the right wheel assembly axle 15*a* extends transversely into the right bearing sleeve 17 carried by the right bottom rail 23.

As shown in FIG. 1 for example, with each of the right and left wheel assembly axles (aka journals) 15*a*, 35*a* pivotally mounted in the respective right and left wheel bearings 17, 18, the wheels 33, 34, 13, 14 of each of the wheel assemblies 11, 31 rests on the ground and each of the front legs 10*a*, 10*b* and rear legs 16*a*, 16*b* of the frame also rests on the ground. In this way, when being pulled from the handle 19 and negotiating a relatively elevated section of the path on the left side of the frame for example, the rear left wheel 33 can raise above the front left wheel 34 and then dip below the front left wheel 34 as the frame moves past the bump in the path while the frame maintains a relatively horizontal orientation during this transition past the bump. Similarly, the rear right wheel 13 can rise above the front right wheel 14 and then dip below the front right wheel 14 as the frame moves past the bump in the path while the frame maintains a relatively horizontal orientation during this transition past the bump.

In accordance with one aspect of the present invention, a quick-disconnect member desirably is selectively connected to each of the wheel assemblies and configured to selectively permit quickly disconnecting that wheel assembly from one side of the frame. As embodied herein and shown in FIG. 9, a hole 35*b* is defined through the left wheel assembly axle 35*a* near the free end thereof, and the hole 35*b* is configured to receive therein a quick-disconnect member in the form of a cotter pin 35*c*. After the left wheel assembly axle 35*a* of the inner left wheel support 32*b* is inserted through the opening 18*a* in the left wheel bearing 18, the cotter pin 35*c* is inserted through the hole 35*b* to complete the rotational attachment of the inner left wheel support 32*b* of the left wheel assembly 31 to the lower left rail 24 of the frame 20. As shown in FIG. 17, a hole 15*b* is defined through the right wheel assembly axle 15*a* near the free end thereof, and the hole 15*b* is configured to receive therein a quick-disconnect member in the form of a cotter pin 15*c*. As shown in FIGS. 12 and 17 for example, the cotter pin 15*c* similarly is used to complete the rotational attachment of the right wheel assembly axle 15*a* of the inner right wheel support 12*b* of the right wheel assembly 11 to the right bottom rail 23 of the frame 20. In this way, the user's selective removal or insertion of the cotter pin 15*c* or 35*c* provides for quick disassembly or assembly, respectively, of the respective wheel assembly 11, 31 from and to the frame 20 for ease of shipping and ease of re-assembly after shipping.

Figure 3:
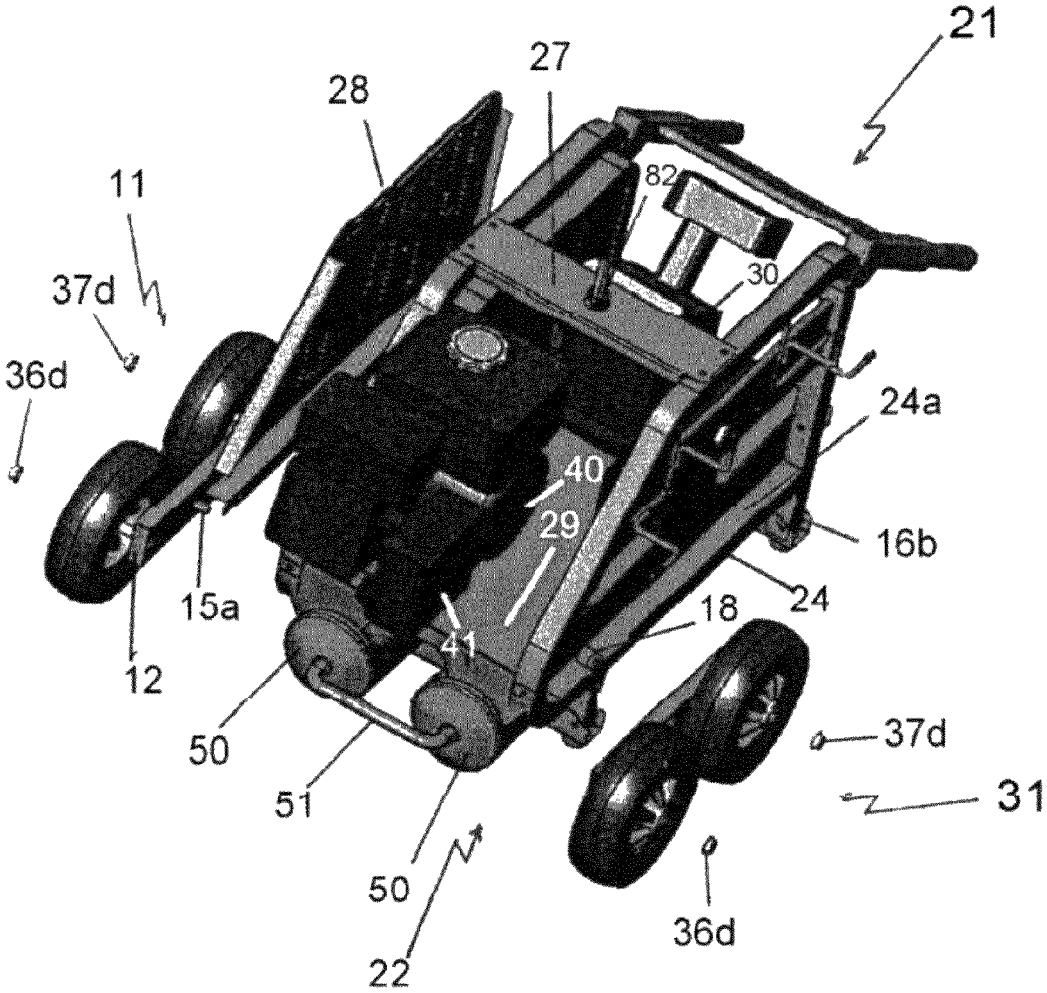
FIG. 3 is an elevated perspective view of the front and left side of a partially assembled, preferred embodiment of the wheeled, manually movable, internal combustion engine powered air compressor of the present invention.

With reference to FIGS. 3, 11 and 12 for example, the respective right wheel bearing 17 that rotatably receives the right wheel assembly axle 15*a* of the right wheel assembly 11 and the left wheel bearing 18 that rotatably receives and supports the left wheel assembly axle 35*a* of the left wheel assembly 31 will be disposed between the front end 22 of the frame 20 and the center of gravity of the overall unit 15, whether the air compressor is with or without a full tank of fuel. In a presently preferred embodiment, the central axis of the opening 17*a* defined by the right wheel bearing 17 desirably is disposed about seven and one-quarter inches from the front edge of the right front member 22*a* of the frame 20 and about twenty-four and one-half inches from the rear edge of the right rear upright member 21*a* of the frame 20. The preferred disposition of the central axis of the opening 18*a* is the mirror image of the location of the central axis of the opening 17*a*. With these locations of the right and left wheel assembly sleeve bearings 17, 18, each of the right wheel assembly 11 and left wheel assembly 31 will become pivotally mounted to the frame 20 such that the pivot points at the centers of the axes of rotation of the respective wheel assembly axles 15*a*, 35*a* facilitate maneuvering over rough terrain with a full tank of fuel without fear of the air compressor unit 15 tipping over the front wheels 14, 34. Moreover, each of the right wheel assembly 11 and the left wheel assembly 31 desirably pivots independently of the other wheel assembly. Thus, each of the right wheel assembly 11 and left wheel assembly 31 can negotiate independently of each other over relatively raised obstructions or through depressions in the path.

Referring to FIGS. 9 and 10 for example, to assemble the left wheel assembly 31 for example, the front wheel axle 36 is passed through the front wheel bearing of the front wheel 34 and through the front axle sleeve 36*b* (FIG. 10) and the aligned concentric opening 36*e* in the outer left wheel support 32*a*, and the free end of the front axle 36 is secured by a fastener 36*c*, which desirably can be a washer that is press-fit onto the free end of the front axle 36. The free end of the front wheel axle 36 can be covered with a cap 36*d*. The same procedure can be followed for the rear wheel 33, the rear wheel axle 37, the rear axle sleeve 37*b* in the outer left wheel support 32*a*, the fastener 37*c* for the free end of the rear wheel axle 37, and a cap 37*d*. When the components of the left wheel assembly 31 in FIG. 9 are fully assembled, a presently preferred embodiment of the left wheel assembly 31 desirably weighs about fifteen pounds. Alternatively, as shown in FIGS. 4 and 5 for example, the outer left wheel support 32*a*, 12*a* can be eliminated from the respective left wheel assembly 31 and right wheel assembly 11.

When the left wheel assembly 31 is so assembled, the axes of rotation of the front and rear axles 36, 37 are perpendicular to the parallel planes that define the outer left wheel support 32*a* and the inner left wheel support 32*b* and parallel to the axis of rotation of the left wheel assembly axle 35*a*. Moreover, as shown in FIGS. 6 and 9 for example, the front left wheel 34 and the rear left wheel 33 desirably are aligned with each other such that the axis of rotation of each wheel is spaced apart from and parallel to the axis of rotation of the other wheel in the left wheel assembly 31.

As shown in FIG. 9, a short length of cylindrical steel tubing can be disposed as a left side pivot pin 38*a* having one opposite end mounted (as by welding for example) to the inner left wheel support 32*b* and extending in the same direction as and parallel to the left wheel assembly axle 35*a*. The left side pivot pin 38*a* has a diameter of about one half inch. As shown in FIGS. 10 and 12, the left side pivot pin 38*a* desirably is surrounded by a cylindrically shaped rubber sleeve 38 such that the combined diameter of the left side pivot pin 38*a* and sleeve 38 is about one inch.

As shown in FIG. 10, the left side pivot pin 38*a* is disposed between the left wheel assembly axle 35*a* and the end 37*a* of the rear wheel axle 37 that is attached to the inner left wheel support 32*b*. In a presently preferred embodiment, the central axis of the left side pivot pin 38*a* desirably is disposed about two inches closer to the closer end of the inner left wheel support 32*b* than the central axis of the left wheel assembly axle 35*a*. Moreover, the central axis of the left side pivot pin 38*a* is disposed about one-quarter inch farther from the lower edge 32*d* of the inner left wheel support 32*b* than is the central axis of the left wheel assembly axle 35*a*. The relative positioning of the right pivot pin 38*b* and the right wheel assembly axle 15*a* in the right wheel support 12 are the mirror images of the corresponding left pivot pin 38*a* and the left wheel assembly axle 35*a* in the left wheel support 32. Thus, as shown in FIGS. 12, 17 and 18, a right side pivot pin (covered by the rubber sleeve 38 in FIG. 12) has one opposite end mounted (as by welding for example) to the inner right wheel support 12*b* and extending in the same direction as and parallel to the right wheel assembly axle 15*a*.

As shown in FIG. 17, a shim 23*b* desirably is disposed on the upper surface 23*a* of the right bottom rail 23 and positioned so that the upper surface 23*c* of the shim 23*b* can be contacted by the rubber sleeve 38 of the right pivot pin 38*b*. The pencil point shown in FIG. 17 is pointing at the upper surface 23*c* of the shim 23*b*. Though not shown in the same detail as in FIG. 17, a similar shim 24*b* desirably is disposed on the upper surface 24*a* of the left bottom rail 24 and positioned so that the upper surface 24*c* of the shim 24*b* can be contacted by the rubber sleeve 38 of the left pivot pin 38*a*. In a presently preferred embodiment, the upper surface 23*c*, 24*c* of each such shim 23*b*, 24*b* desirably is disposed about one quarter inch above the respective upper surface 23*a*, 24*a* of the respective bottom rail 23, 24.

Figure 18:
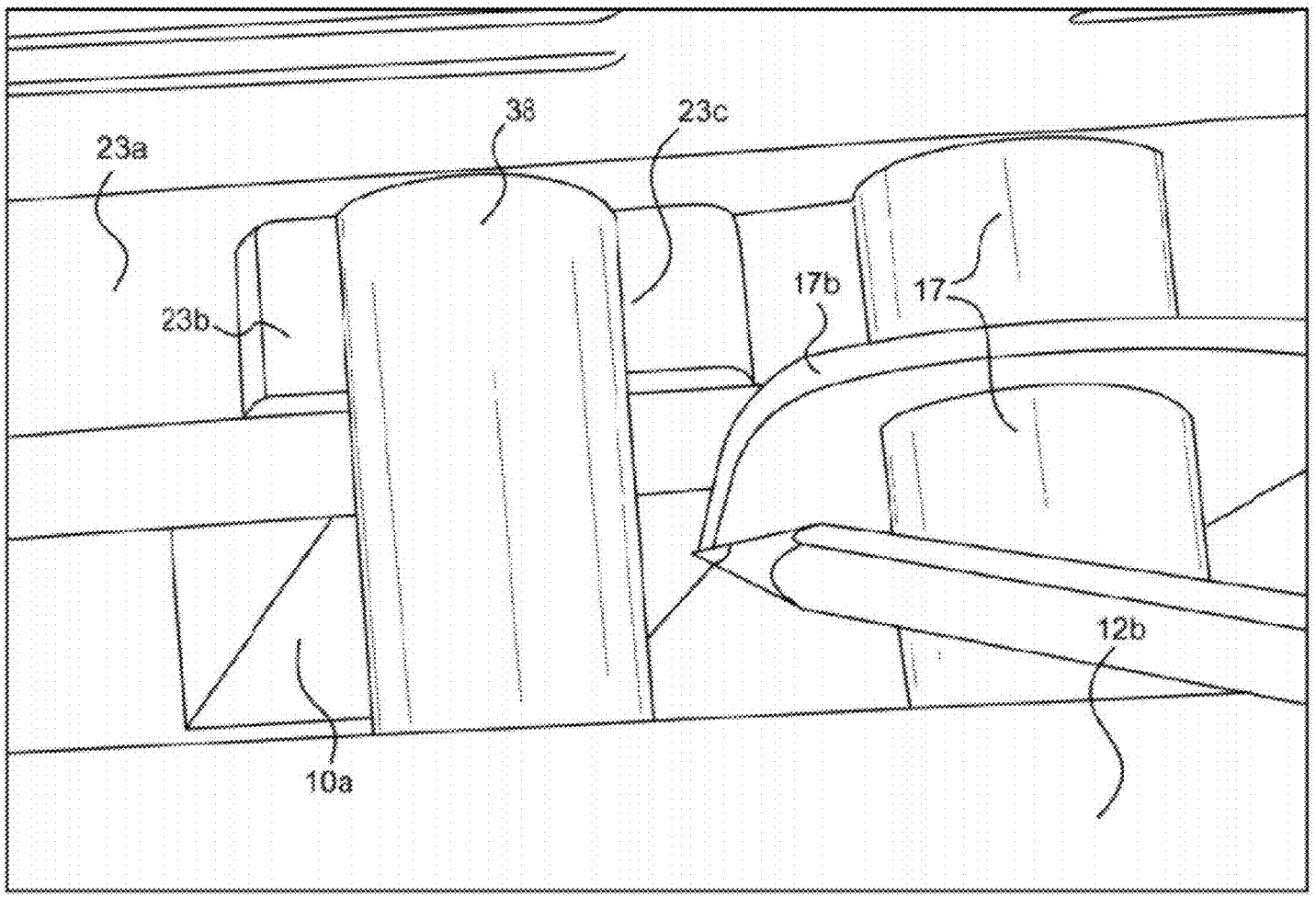
FIG. 18 is an elevated perspective view of assembled components of a presently preferred embodiment of a wheeled, manually movable, internal combustion engine powered air compressor unit of the present invention.

In FIG. 18, which shows a perspective close up view of a section of a presently preferred embodiment of the air compressor unit, the point of a pencil is shown pointing to the right front leg 10*a*. Desirably, the center line of the right front leg 10*a* is about one and three-quarters inches in the rearward direction from the central axis of the cylindrically shaped opening 17*a* that is defined by the right wheel bearing 17. As shown in FIG. 18, this position of the right front leg 10*a* disposes the right front leg 10*a* in beneath where the right pivot pin 38*b* that is covered by the rubber sleeve 38 engages the upper surface 23*c* of the shim 23*b* that is disposed on the upper surface 23*a* of the bottom right rail 23. The position of the left front leg 10*b* is the mirror image of the position of the right front leg 10*a*.

As shown in FIG. 6 for example, it is important that the pivot pins 38*a*, 38*b* be disposed between the wheel assembly axles 35*a*, 15*a* and the rear end 21 of the air compressor unit 15. With this relative disposition of the pivot pins 38*a*, 38*b* in relation to the respective wheel assembly axles 35*a*, 15*a* and their respective sleeve bearings 18, 17 for the axles 35*a*, 15*a*, when the air compressor unit 15 is resting on all four wheels 34, 33, 14, 13 as in FIGS. 12, 17 and 19A for example, the lowermost surface of the annular rubber sleeve 38 covering each respective pivot pin 38*a*, 38*b* of the left wheel support 32 and the right wheel support 12 respectively, is desirably spaced vertically about one quarter of an inch above the upper surface 24*c*, 23*c* of the corresponding shim 24*b*, 23*b* on the respective bottom rail 24, 23.

Figure 19B:
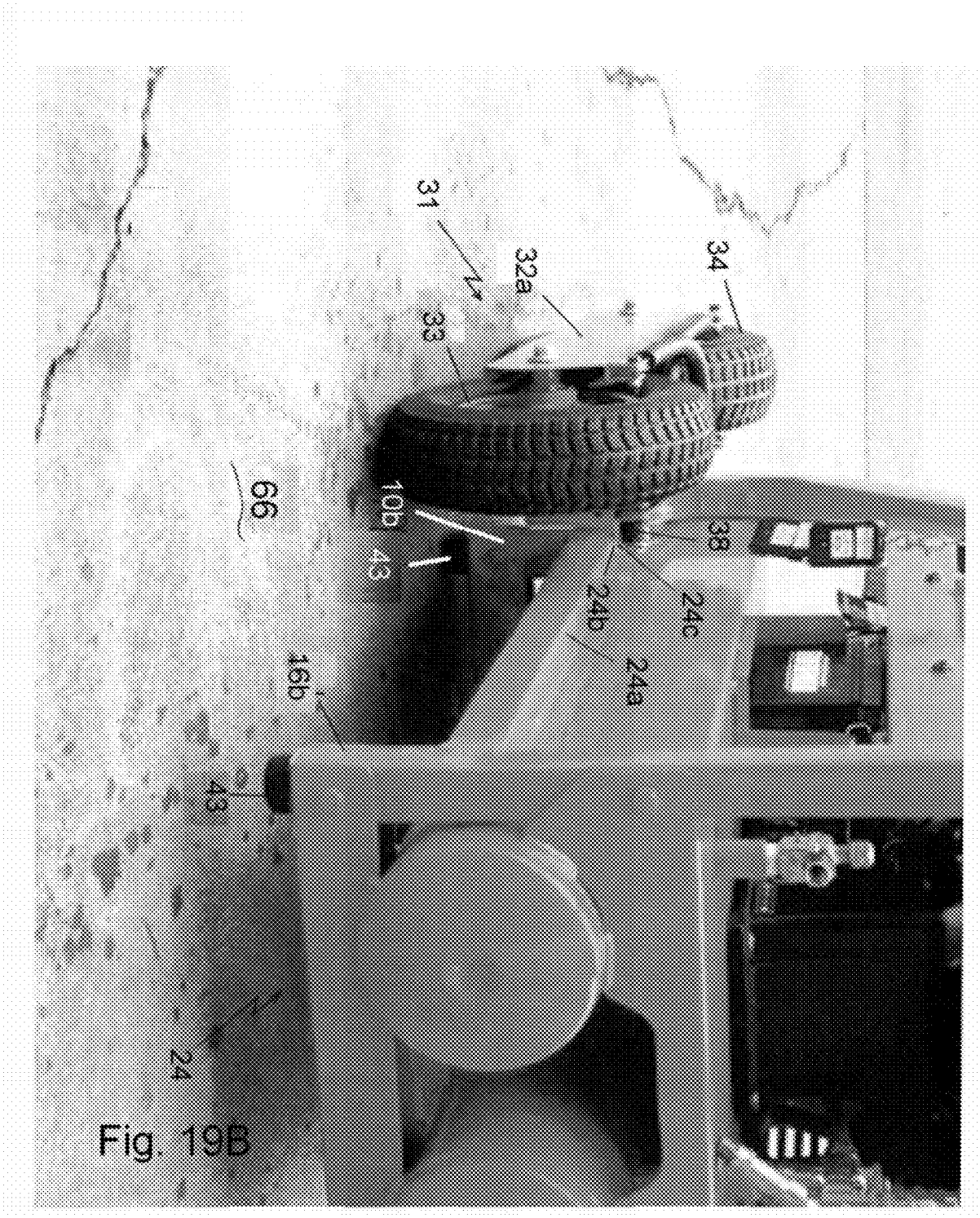
FIG. 19B is an elevated perspective view of assembled components of a presently preferred embodiment of a wheeled, manually movable, internal combustion engine powered air compressor unit of the present invention.

However, as shown in FIG. 19B for example, when the rear end 21 of the frame of the air compressor unit is lifted vertically away from the ground 66 using the dual rear handles 19*a*, 19*b* (not visible), and before each respective rubber sleeve 38 of each pivot pin 38*a*, 38*b* of the left wheel support 32 and the right wheel support 12 respectively comes into contact with and engages the upper surface 24*c*, 23*c* of the corresponding shim 24*b*, 23*b* on the frame's corresponding bottom rail 24, 23, first the support cushions 43 on the rear legs 16*a*, 16*b* and then the support cushions 43 on the front legs 10*a*, 10*b* are lifted off the ground 66 so that only the respective wheels 33, 34, 13, 14 remain in contact with the ground 66. In this way, when being pulled from the rear handle 19, and negotiating a relatively elevated section of the path on the left side of the frame for example, the rear right wheel 13 can rise above the front right wheel 14 and then dip below the front right wheel 14 as the frame moves past the bump in the path while the frame maintains a relatively horizontal orientation during this transition past the bump. Similarly, the rear left wheel 33 can rise above the front left wheel 34 and then dip below the front left wheel 34 as the frame moves past the bump in the path while the frame maintains a relatively horizontal orientation during this relatively easy transition past the bump.

Figure 14:
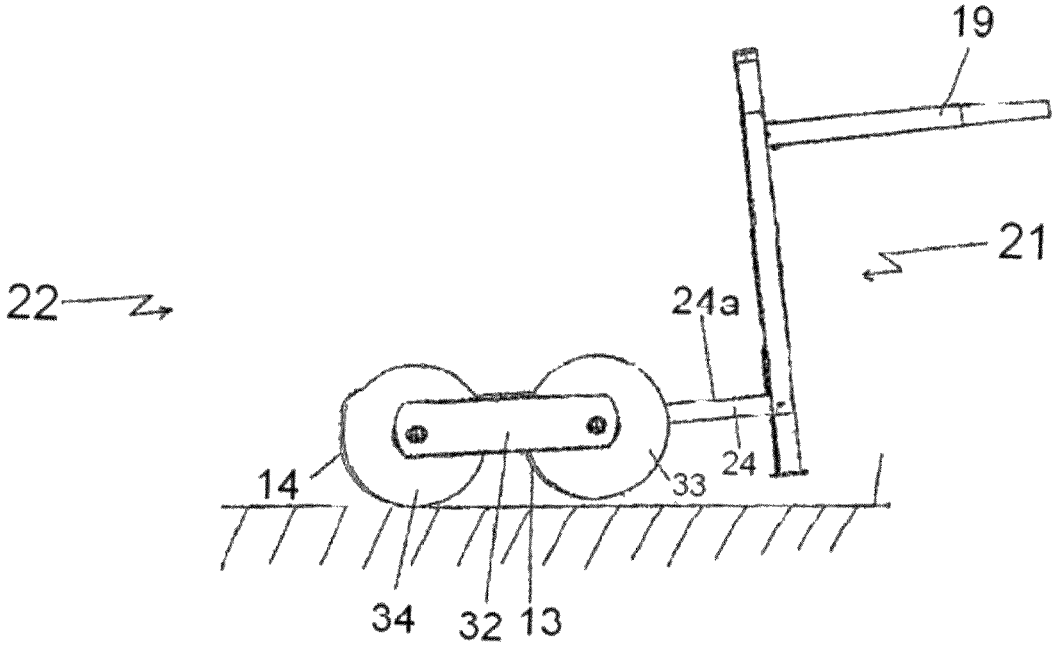
FIG. 14 is a plan view from the left side of components of a partially assembled embodiment of the wheeled, manually movable, internal combustion engine powered air compressor unit of the present invention.
Figure 15:
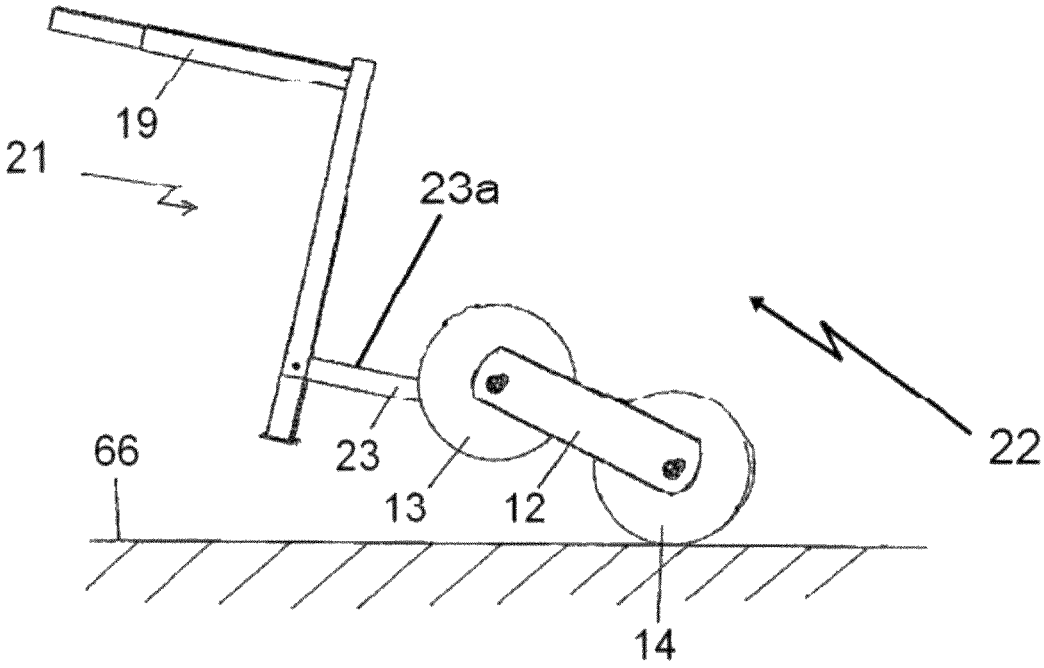
FIG. 15 is a plan view from the right side of components of a partially assembled embodiment of the wheeled, manually movable, internal combustion engine powered air compressor unit of the present invention.
Figure 19C:
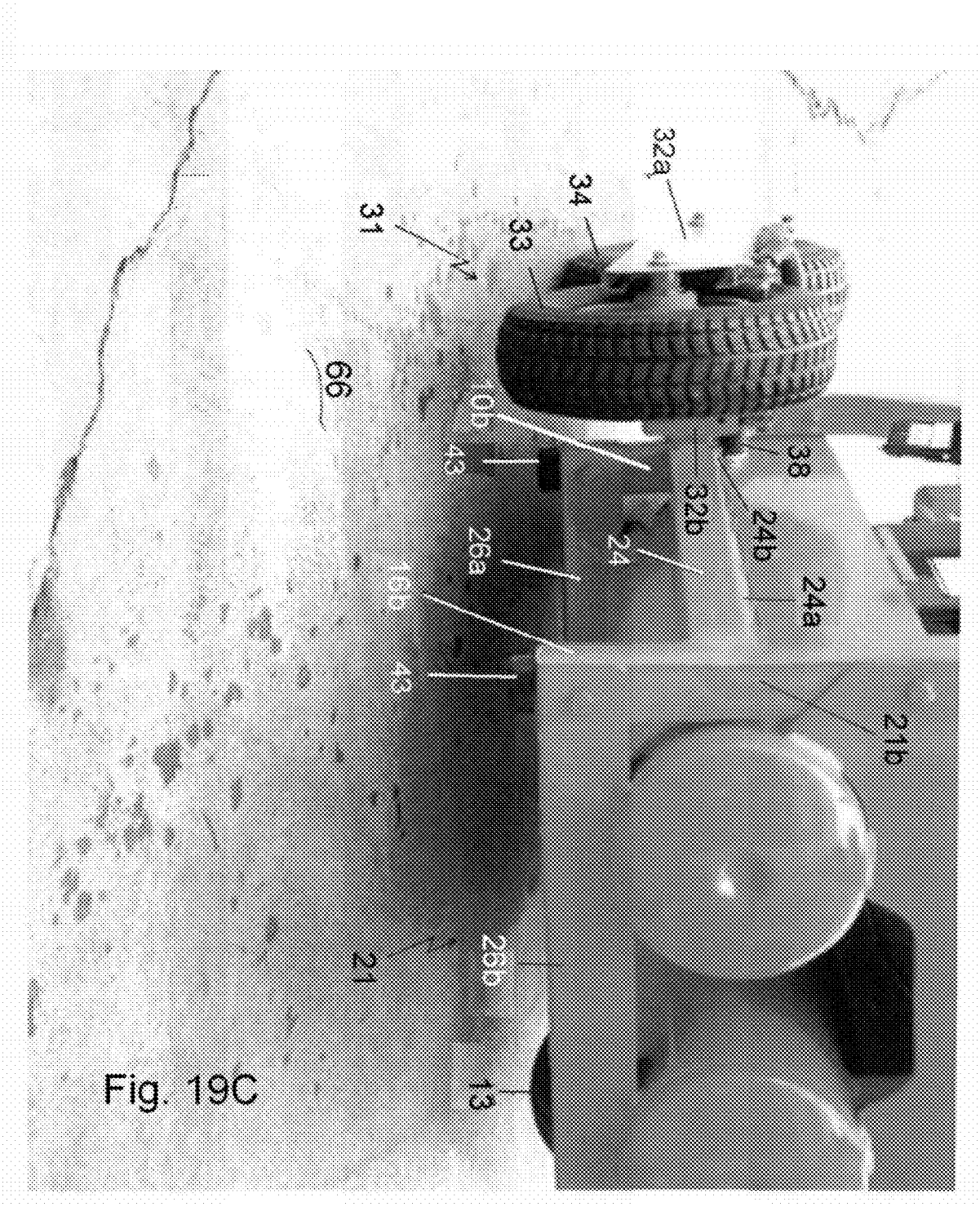
FIG. 19C is an elevated perspective view of assembled components of a presently preferred embodiment of a wheeled, manually movable, internal combustion engine powered air compressor unit of the present invention.

As shown in FIG. 19C for example, only when further lifting of the rear handles 19*a*, 19*b* (not visible) causes each respective rubber sleeve 38 of each pivot pin 38*a*, 38*b* of the left wheel support 32 and the right wheel support 12 respectively to come into contact with and engage the upper surface 24*c*, 23*c* of the corresponding shim 24*b*, 23*b* on the frame's corresponding bottom rail 24, 23, do the rear wheels 33, 13 become lifted away from contact with the ground 66. The upwardly tilted condition of the rear wheels 33, 13 of the air compressor unit 15 is also illustrated in a left side plan view in FIG. 14 and in a right side plan view in FIG. 15. In so lifting the rear wheels 33, 13 off the ground, it becomes easier for the air compressor unit 15 to be pivoted on just the two front end wheels 34, 14 so that the entire air compressor unit 15 can be pivoted from side to side, left or right, on the two front end wheels 34, 14.

Moreover, if the retractable rear handle 19 at the rear end 21 of the frame is being used to pull the air compressor unit 15 over the terrain in the path of the wheels 13, 14, 33, 34 of the air compressor unit 15 when negotiating a relatively elevated section of the path (such as a curb) on the left side of the frame for example, the rear left wheel 33 can raise above the front left wheel 34 as the frame moves past the bump in the path. In so doing, it also becomes easier for the air compressor unit 15 to be pulled from the rear end 21 on just the two front end wheels 34, 14 so that the rear wheels 33, 13 become elevated to encounter an elevated obstruction and ease the transition of the air compressor unit 15 over an elevated obstruction in the path of the air compressor unit 15.

As shown in FIGS. 10 and 12B for example, a retractable, wheel lock 70 desirably can be pivotally mounted to a pair of opposed wheel lock flanges 71 that are fixed to the outer left wheel support 32*a* and inner left wheel support 32*b*, respectively. In this embodiment, a separate wheel lock 70 desirably is provided for each of the left wheels 33, 34. However, in an alternative embodiment, a separate wheel lock 70 desirably can be provided for each of the right wheels 13, 14, either additionally or instead of the ones provided for the left wheels 33, 34.

As shown in FIGS. 10 and 12B for example, each wheel lock 70 desirably can be provided in the form of a U-shaped rod that has the two free ends. Each of the two free ends of each wheel lock 70 desirably can be opposed to one another and pivotally connected to one of the wheel assemblies. Each U-shaped rod defines an intermediate section disposed between the opposed free ends and the closed loop portion, and the intermediate section desirably is bent at an angle relative to the plane in which the closed loop portion of the U-shaped rod resides. When engaged as a wheel brake, the closed loop portion of the wheel lock 70 contacts the respective rolling surface of the wheel 33, 34 and prevents the respective wheel from rotating in the direction toward the closed loop portion. When both wheel locks 70 are engaged to the respective wheels 33, 34, the left side of unit 15 is prevented from rolling forward or backward While at least one presently preferred embodiment of the invention has been described using specific terms, such description is for illustrative purposes only, and it is to be understood that changes and variations may be made without departing from the spirit or scope of the invention.

What is claimed is:

1. A wheeled, manually movable, internal combustion engine powered air compressor, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

at least one pressurized gas storage tank carried by said frame;

an air compression pump carried by said frame and connected to said at least one pressurized gas storage tank;

a first wheel assembly connected pivotally to said first side of said frame and rotatably carrying at least a first wheel; and a second wheel assembly connected pivotally to said second side of said frame and rotatably carrying at least a second wheel;

wherein said first wheel assembly including a first pivot pin extending transversely from said first wheel assembly and disposed to engage said frame and lift one end of said first wheel assembly with respect to the ground when one end of said frame is lifted a predetermined distance above the ground.

2. An apparatus as in claim 1, further comprising:

a first quick-disconnect member selectively connected to said first wheel assembly and configured to selectively permit quickly disconnecting said first wheel assembly from said first side of said frame.

3. An apparatus as in claim 2, wherein said first quick-disconnect member is formed by a cotter pin and said first wheel assembly includes a first wheel assembly journal having a free end defining a hole configured to receive said cotter pin.

4. An apparatus as in claim 1, wherein said first wheel assembly includes a first wheel assembly axle that is pivotally connected to the first side of the frame and the first pivot pin defines a central axis of symmetry that is disposed between the first wheel assembly axle and the rear end of the frame.

5. An apparatus as in claim 1, wherein:

said first wheel assembly including a first front wheel rotatably mounted to said first wheel assembly and a first rear wheel rotatably mounted to said first wheel assembly, said second wheel assembly including a second front wheel rotatably mounted to said second wheel assembly and a second rear wheel rotatably mounted to said second wheel assembly.

6. An apparatus as in claim 5, wherein:

said first front wheel of said first wheel assembly is spaced apart in said axial direction of said frame from said first rear wheel of said first wheel assembly.

7. A wheeled, manually movable, internal combustion engine powered air compressor, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

at least one pressurized gas storage tank carried by said frame;

an air compression pump carried by said frame and connected to said at least one pressurized gas storage tank;

a first wheel assembly connected pivotally to said first side of said frame and rotatably carrying at least a first wheel; and a second wheel assembly connected pivotally to said second side of said frame and rotatably carrying at least a second wheel;

wherein:

said first wheel assembly including a first inner wheel support defining an outer side and an inner side disposed opposite said outer side, said first wheel assembly including a front wheel axle extending from said outer side of said first inner wheel support, said first wheel assembly including a rear wheel axle extending from said outer side of said first inner wheel support and spaced apart from said front wheel axle, said first wheel assembly including a first wheel assembly journal extending from said inner side of said first inner wheel support and extending in a transverse direction parallel to said front wheel axle and said rear wheel axle, said first wheel assembly journal being pivotally connected to said first side of said frame;

said second wheel assembly including a second inner wheel support defining an outer side and an inner side disposed opposite said outer side, said second wheel assembly including a front wheel axle extending from said outer side of said second inner wheel support, said second wheel assembly including a rear wheel axle extending from said outer side of said second inner wheel support and spaced apart from said front wheel axle, said second wheel assembly including a second wheel assembly journal extending from said inner side of said second inner wheel support and extending parallel to said front wheel axle and said rear wheel axle, said second wheel assembly journal being pivotally connected to said second side of said frame.

8. An apparatus as in claim 7, wherein:

said first wheel assembly including a first pivot pin extending from said inner side of said first inner wheel support of said first wheel assembly and disposed closer to said rear wheel axle of said first wheel assembly than to said front wheel axle of said first wheel assembly; and said second wheel assembly including a second pivot pin extending from said second inner side of said inner wheel support of said second wheel assembly and disposed closer to said rear wheel axle of said second wheel assembly than to said front wheel axle of said second wheel assembly.

9. An apparatus as in claim 8, wherein:

said first pivot pin is disposed between the first wheel assembly journal and the rear end of the frame and said second pivot pin is disposed between the second wheel assembly journal and the rear end of the frame.

10. An apparatus as in claim 1, further comprising:

a battery carried by said frame and electrically connected to said engine.

11. An apparatus as in claim 1, further comprising:

a first wheel locking mechanism selectively disposable to prevent rotation of said first wheel, said first wheel locking mechanism including a U-shaped rod having two opposed free ends pivotally connected to said first wheel assembly.

12. An apparatus as in claim 1, further comprising:

a rear handle selectively retractably mounted to the rear end of the frame.

13. An apparatus as in claim 1, wherein:

said frame defining a main floor panel extending between the first side and the second side of said frame; and said at least one pressurized gas storage tank is disposed beneath said main floor panel.

14. An apparatus as in claim 1, further comprising:

at least one top crossbrace extending transversely between said frame's first side and second side; and a lifting eye fixture detachably connected to said top crossbrace.

15. An apparatus as in claim 1, wherein said fuel tank has a capacity of at least two gallons and the uppermost outline of said fuel tank is disposed essentially flush with the uppermost outline of said frame.

16. An apparatus as in claim 1, further comprising:

a pair of rear legs connected to said rear end of said frame, a pair of front legs spaced apart from said rear legs and connected to said frame, each of said legs having a free end, and each of said legs being provided with a respective support cushion connected to said respective free end of said respective leg.

17. A wheeled, manually movable, internal combustion engine powered air compressor, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

at least one pressurized gas storage tank carried by said frame;

an air compression pump carried by said frame and connected to said at least one pressurized gas storage tank;

a first wheel assembly connected pivotally to said first side of said frame and rotatable carrying at least a first wheel;

a second wheel assembly connected pivotally to said second side of said frame and rotatably carrying at least a second wheel; and a pair of rear legs connected to said rear end of said frame, a pair of front legs spaced apart from said rear legs and connected to said frame, each of said legs having a free end, and each of said legs being provided with a respective support cushion connected to said respective free end of said respective leg;

wherein each respective support cushion is formed of resilient, high friction material;

wherein said first wheel assembly including a first pivot pin extending transversely from said first wheel assembly and disposed to engage said frame and lift one end of said first wheel assembly and disposed to engage said frame and lift one end of said first wheel assembly with respect to the ground when one end of said frame is lifted a predetermined distance above the ground.

18. A wheeled, manually movable, internal combustion engine powered air compressor, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side, said frame including at least one top crossbrace extending transversely between said frame's first side and second side;

a first wheel assembly and a second wheel assembly, said first wheel assembly being pivotally connected to said first side of said frame and said second wheel assembly being pivotally connected to said second side of said frame;

said first wheel assembly including a first front wheel rotatably mounted to said first wheel assembly and a first rear wheel rotatably mounted to said first wheel assembly, said second wheel assembly including a second front wheel rotatably mounted to said second wheel assembly and a second rear wheel rotatably mounted to said second wheel assembly;

said first wheel assembly including a first quick-disconnect member configured to selectively permit quickly disconnecting said first wheel assembly from said first side of said frame, said second wheel assembly including a second quick-disconnect member configured to selectively permit quickly disconnecting said second wheel assembly from said second side of said frame;

said first wheel assembly including an inner wheel support defining an outer side and an inner side disposed opposite said outer side, said first wheel assembly including a front wheel axle extending from said outer side of said inner wheel support, said first wheel assembly including a rear wheel axle extending from said outer side of said inner wheel support and spaced apart from said front wheel axle, said first wheel assembly including a first wheel assembly journal extending from said inner side of said inner wheel support and extending in a transverse direction parallel to said front wheel axle and said rear wheel axle;

said first wheel assembly including a first pivot pin extending from said inner side of said inner wheel support of said first wheel assembly and disposed closer to said rear wheel axle of said first wheel assembly than to said front wheel axle of said first wheel assembly;

said second wheel assembly including an inner wheel support defining an outer side and an inner side disposed opposite said outer side, said second wheel assembly including a front wheel axle extending from said outer side of said inner wheel support, said second wheel assembly including a rear wheel axle extending from said outer side of said inner wheel support and spaced apart from said front wheel axle, said second wheel assembly including a second wheel assembly journal extending from said inner side of said inner wheel support and disposed symmetrically with respect to said front wheel axle and said rear wheel axle;

said second wheel assembly including a second pivot pin extending from said inner side of said inner wheel support of said second wheel assembly and disposed closer to said rear wheel axle of said second wheel assembly than to said front wheel axle of said second wheel assembly;

a first wheel locking mechanism connected to said first wheel assembly and selectively disposable to prevent rotation of at least one of said first front wheel and said first rear wheel, said first including wheel locking mechanism a first U-shaped rod having two opposed free ends pivotally connected to said first wheel assembly and selectively disposable to prevent rotation of one of said first front wheel or said first rear wheel, said first U-shaped rod having a closed loop portion opposite the two free ends opposed to each other, said first U-shaped rod defining an intermediate section disposed between the opposed free ends and the closed loop portion, said intermediate section being bent at an angle relative to the plane in which the closed loop portion of the U-shaped rod resides;

an internal combustion engine carried by said frame and including a rotatable output shaft;

a battery carried by said frame and electrically connected to said engine;

at least one pressurized gas storage tank carried by said frame;

an air compression pump carried by said frame and connected to said rotatable output shaft of said engine and having an outlet connected to said at least one pressurized gas storage tank;

a rear handle selectively retractably mounted to the rear end of the frame; and a lifting eye fixture detachably connected to said top cross-brace.

* * * * *